US006348028B1

(12) United States Patent
Cragg

(10) Patent No.: US 6,348,028 B1
(45) Date of Patent: Feb. 19, 2002

(54) MULTI-PURPOSE TRAINING APPARATUS

(76) Inventor: Brandon Cragg, 119 Merriam Ave., Newton, NJ (US) 07860

( * ) Notice: Subject to any disclaimer, the term of this patent is extended or adjusted under 35 U.S.C. 154(b) by 0 days.

(21) Appl. No.: 09/559,696

(22) Filed: Apr. 27, 2000

(51) Int. Cl.[7] ..... A63B 71/00

(52) U.S. Cl. ..... 482/148; 482/83; 482/86; 473/447; 473/479; 472/118; 434/248

(58) Field of Search ..... 482/83, 86, 87, 482/89, 148; 473/447, 479; 434/248; 472/118; D21/246

(56) References Cited

U.S. PATENT DOCUMENTS

| | | | | |
|---|---|---|---|---|
| 419,285 | A | * | 1/1890 | Sanborn |
| 835,796 | A | * | 11/1906 | Lindsley |
| 1,582,487 | A | * | 4/1926 | Shank |
| 1,708,638 | A | * | 4/1929 | Smith |
| 1,744,594 | A | * | 1/1930 | Trzesniewski |
| 2,643,466 | A | * | 6/1953 | Bucher |
| 2,977,118 | A | * | 3/1961 | Farkas |
| 3,250,533 | A | * | 5/1966 | Nicholson |
| 3,252,242 | A | * | 5/1966 | Zalkind |
| 3,724,845 | A | * | 4/1973 | Irby ..... 482/83 |
| 4,084,812 | A | * | 4/1978 | Melrose et al. ..... 472/118 |
| 4,569,401 | A | * | 2/1986 | Luck ..... 482/57 |
| 5,531,656 | A | * | 7/1996 | Varghese ..... 482/69 |

FOREIGN PATENT DOCUMENTS

| | | | | |
|---|---|---|---|---|
| JP | 6-178834 | * | 6/1994 | ..... 482/83 |

* cited by examiner

*Primary Examiner*—Jerome W. Donnelly
*Assistant Examiner*—Lori Baker Amerson
(74) *Attorney, Agent, or Firm*—Robert M. Downey, P.A.

(57) ABSTRACT

A training apparatus has a primary frame structure including a pair of base members, first and second vertical post assemblies each including a lower vertical post member attachable to a respective base member and an upper vertical post member telescopically received within the lower vertical post members and selectively positionable relative thereto to adjust a height of a top end of the upper vertical post member, and a horizontal cross beam assembly including a pair of elongate cross beam members. The top ends of the upper vertical post members are provided with receptacles for receipt of outboard ends of the cross beam members so that the horizontal cross beam assembly spans between the spaced apart vertical post assemblies at a selected, adjusted height above the floor. The frame structure is fully collapsible and can be reconfigured to accommodate a wide variety of accessory components which removably attach to the frame structure to facilitate workouts and training in a vast array of sports and activities. The frame structure collapses and assembles on a dolly to form a cart for transporting the apparatus, including the frame structure and accessory components.

10 Claims, 21 Drawing Sheets

MULTI-PURPOSE TRAINING APPARATUS

BACKGROUND OF THE INVENTION

1. Field of the Invention

This invention relates to the field of exercise and training equipment, and more particularly to a collapsible, portable apparatus which is adapted to assemble in different configurations to support a variety of accessory component attachments so that a user can workout and train in a vast array of sports and activities, and wherein the apparatus is adapted to collapse and attach to a dolly, to thereby define a portable cart for transporting the apparatus and accessory components between training locations.

2. Description of the Related Art

The art is crowded with exercise equipment for all types of sports and activities. To a large extent, the exercise equipment in the related art is directed to weight lifting or body building, wherein various devices are provided to exercise and build different muscles of the body. In general, exercise equipment falls into two categories, namely, fixed, permanently installed equipment and collapsible equipment. Examples of permanently installed, industrial-type equipment can be found in most health and fitness clubs, as well as in the home gym industry. For example, fitness clubs usually provide a collection of different machines, arranged in one or more large rooms, wherein each machine is dedicated to exercising a particular muscle group. A home gym, on the other hand, usually combines a number of devices into one apparatus wherein several work stations are provided about a fixed frame structure, wherein each sports station usually includes equipment for exercising one or more muscles of the body, including the arms, torso, and legs.

While fitness clubs provide a wide variety of machines for anaerobic as well as aerobic workouts, this type of equipment tends to be extremely heavy and immobile. Further, many people, particularly, younger individuals, do not stay in the same area for an extended period of time. Additionally, a fair percentage of today's work force travel quite frequently, thereby making it difficult to maintain a routine of exercise at a fitness club. In many instances, people who join fitness clubs find that they do not use them after a few months, as it becomes too inconvenient to fit regular visits to the fitness club into one's busy schedule. In other instances, people move to another town and have to forfeit their membership in a fitness club before it expires.

Other health conscious individuals find the means for staying in shape with the use of a home gym apparatus. As with fitness clubs, there is a large number of home gym machines available on the market. These exercise units provide similar ranges of exercises to those found in fitness clubs. However, much like the equipment in fitness clubs, a home gym tends to be very bulky, heavy and generally immobile. This type of equipment can be found in U.S. Pat. No. 4,072,309 to Wilson; U.S. Pat. No. 4,541,627 to MacLean; and U.S. Pat. No. 4,023,715 to Pauls. A further limitation of a home gym is the difficulty in transporting the apparatus to another location should the owner of the equipment need to change residences. And because the average single person or family finds it necessary to move to a new residence at least once every ten years, for work or personal reasons, the need to transport this bulky equipment can be expected. Unfortunately, the cost to disassemble, move, and then reassemble a home gym at a new location can often cost as much or more than the original purchase of the equipment. Furthermore, most individuals do not have sufficient space in their home to accommodate a home gym apparatus.

Portable, collapsible exercise equipment is becoming increasingly popular due to the busy lifestyles of today's health conscious society. Examples of this type of equipment are seen on extended length television commercial advertisements and include stair-stepper machines, rowing machines, sit-up devices, and body building devices. For the most part, this equipment is designed to collapse to a more compact configuration so that it can be stored under a bed or in a closet, thus appealing to those with limited space in their homes. And, while portable, collapsible equipment is available for a wide range of activities, and not limited to body building, each item of equipment tends to be limited to the specific activity to which it was designed for. U.S. Pat. No. 5,803,841 to Daskoski, is an example of a portable training apparatus for training baseball pitchers. Specifically, Daskoski discloses a pitcher's training aid which includes an upright rectangular frame structure made of a horizontal base structure, a vertical target support structure, and at least one vertical brace member. Two horizontal support members are slidably mounted on the opposing vertical sides of the target support structure, thereby defining the boundaries Of a strike zone through which a ball may pass. The vertical height of the strike zone is adjusted by manipulating the positions of the two horizontal support members along the sides of the target support structure. However, the Daskoski device is strictly limited to pitching training and is not adapted for accommodating a variety of accessories and attachments for training in many different sports and activities.

A further problem associated with both permanently installed more industrial-type exercise equipment and portable exercise equipment is the limited range of exercises and activities which can be performed on the equipment. As mentioned above, most exercise equipment is geared towards exercising and building muscles on one or more areas of the body. A smaller percentage of exercise and training equipment is geared to training in specific sports, such as baseball, football, or golf. The various apparatus known for these particular uses is generally limited to one sport or activity. Thus, a person desiring to train in a variety of sports, including weight lifting and body building, must purchase separate equipment for each activity. For most people, this is impractical due to the cost and limited availability of space to accommodate several items of equipment.

It can, therefore, be appreciated that there remains an urgent need for a collapsible, portable multi-purpose training apparatus which is adapted to accommodate a variety of accessory components to enable training in many different sports and activities.

OBJECTS AND ADVANTAGES OF THE INVENTION

In view of the foregoing, it is a primary object of the present invention to provide a multi-purpose collapsible and portable training apparatus which is of efficient, sturdy construction and which offers a wide variety of accessory components for training in many different sports and activities, and further wherein the apparatus is designed for quick and easy assembly and disassembly for transport between training locations.

It is a further object of the present invention to provide a multi-purpose collapsible training apparatus which can be manufactured in a variety of materials and sizes.

It is still a further object of the present invention to provide a multi-purpose training apparatus which can be manufactured in a durable plastic or like material in a size suitable for use by children.

It is a further object of the present invention to provide a multi-purpose collapsible and portable training apparatus which is manufactured in a strong, corrosion-resistant steel, aluminum or other metal alloy for use by persons of all ages.

It is still a further object of the present invention to provide a multi-purpose collapsible training apparatus in a size suitable for use as a toy, wherein the apparatus can be used in conjunction with children's toy action characters.

Further objects and advantages of the invention are more readily apparent with reference to the detailed description and accompanying drawings.

BRIEF DESCRIPTION OF THE DRAWINGS

For a fuller understanding of the nature of the present invention, reference should be made to the following detailed description taken in conjunction with the accompanying drawings, in which.

Like reference numerals refer to like parts throughout the several views of the drawings.

DETAILED DESCRIPTION OF THE PREFERRED EMBODIMENTS

Figure 1:
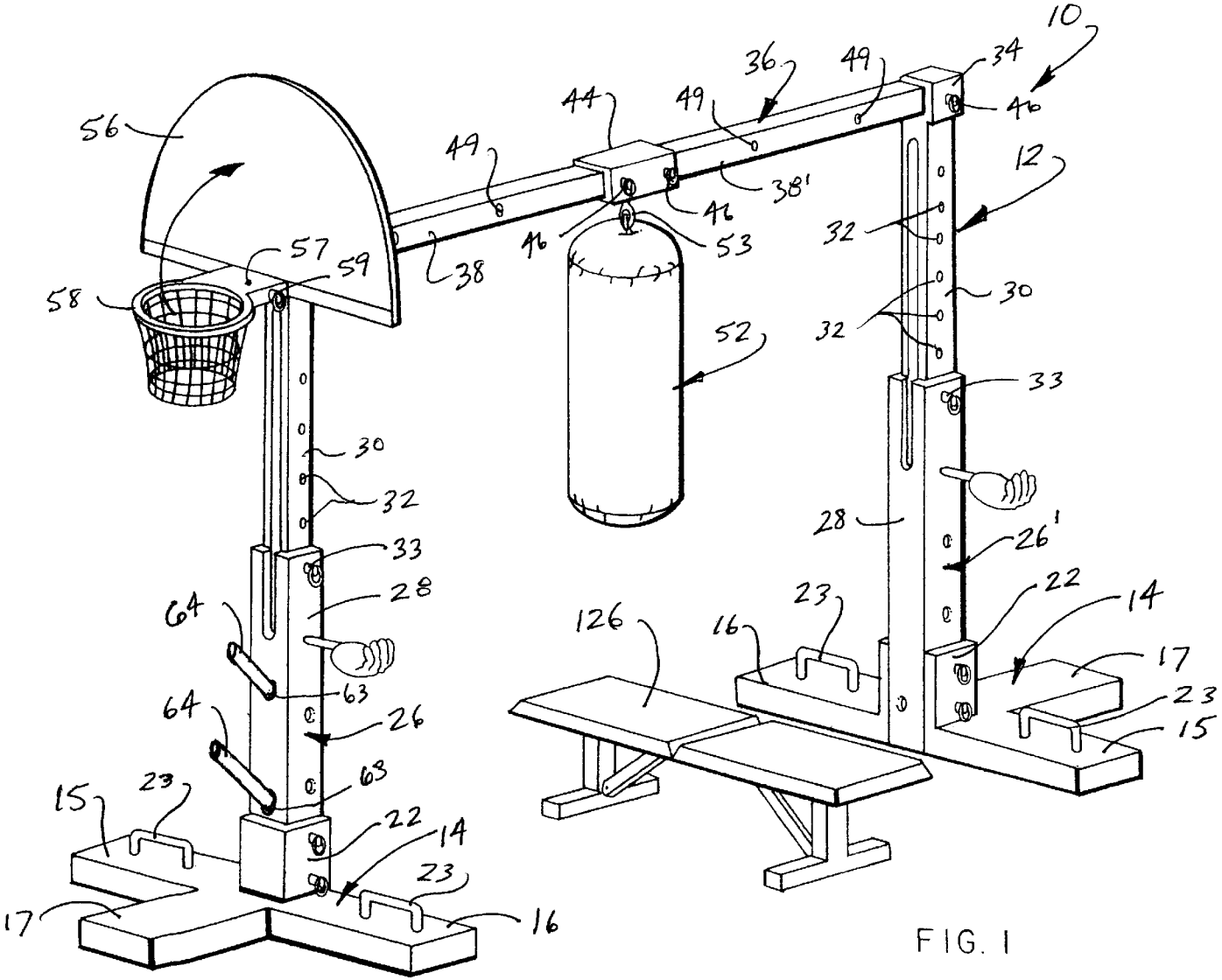
FIG. 1 is a perspective view of the multi-purpose training apparatus of the present invention, shown in an assembled condition with several accessory components attached thereto.
Figure 2:
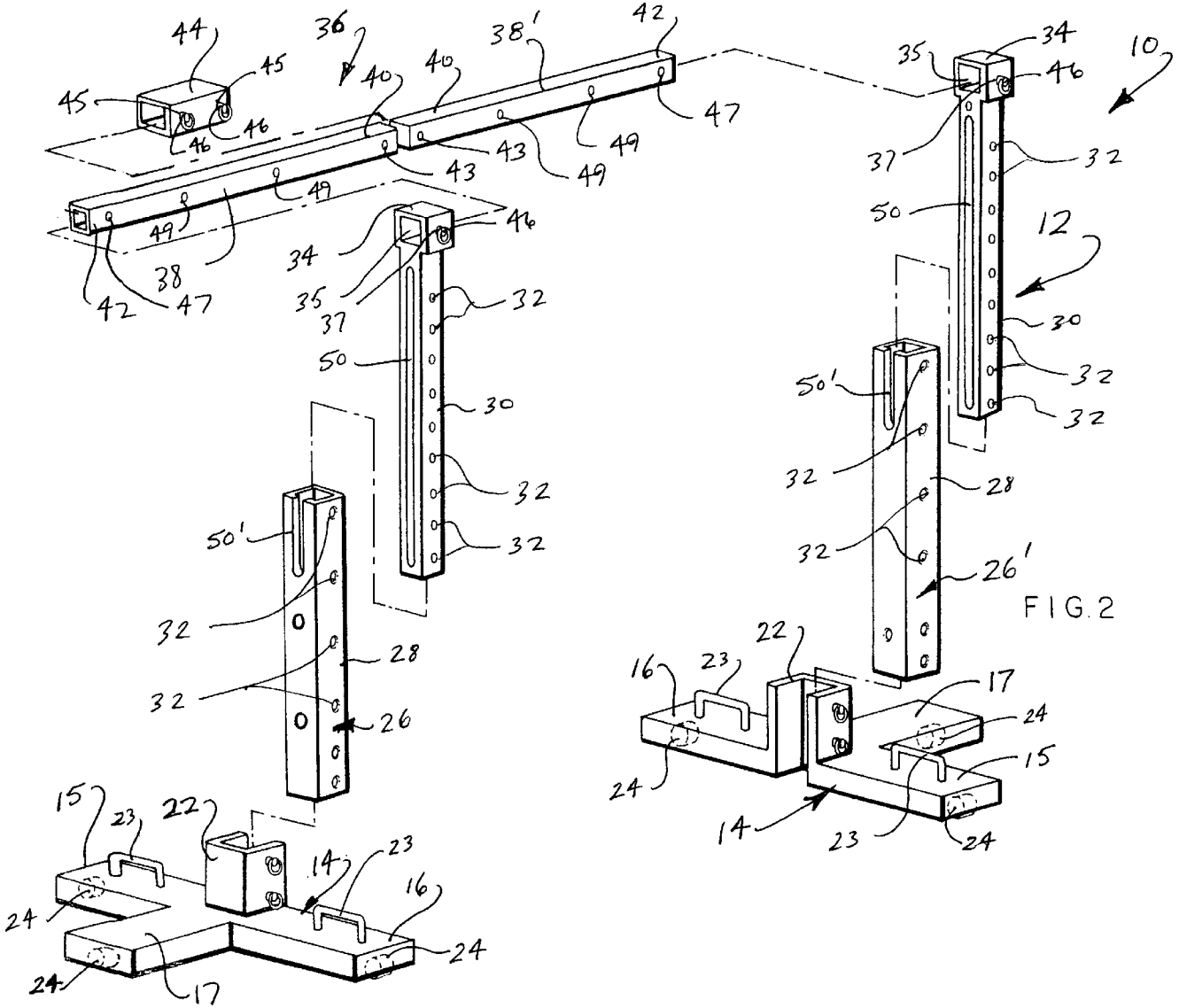
FIG. 2 is an exploded perspective view illustrating assembly of the primary frame structure of the multi-purpose training apparatus.

Referring to the several views of the drawings, and initially FIGS. 1 and 2, the multi-purpose collapsible training apparatus is shown and generally indicated as 10.

The training apparatus 10 includes a primary frame structure 12 consisting of a pair of base members 14 each having three feet sections 15, 16, 17 extending outwardly from a central juncture 18 to define a generally T-shaped configuration. The base members 14 are specifically structured to rest on a flat floor surface with the extending feet sections providing stability. Post sockets 22 extend upwardly from the juncture of each base member to define a generally U-shaped receptacle for fitted receipt of respective vertical post assemblies 26, 26' therein. The bottom side of each base member is provided with spring loaded wheels or rollers 24 which operate between a lowered position to facilitate transport of the apparatus 10 across a floor surface, and a retracted position wherein the wheels 24 are raised up above the bottom surface of the base members to allow the base members to rest firmly on the floor surface without moving, thereby stabilizing the base members in a select location. A pedal or lever 25 may be provided to facilitate raising and lowering of the wheels. The base members 14 are further provided with handles 23 on the top sides of the feet sections 15, 16 for carrying the base members during assembly and disassembly of the apparatus. The handles 23 may be mounted in a manner which permits them to collapse to a folded, stowed position so that the handles are flush with the top surface of the base members. This helps to prevent tripping on the handles when the apparatus is fully assembled for use in a variety of activities, as shown throughout the several views of the drawings.

The vertical post assemblies 26, 26' each include a lower post member 28 and an upper post member 30. In a preferred embodiment, the upper and lower post members 30 are structured to have a four sided, square tubular cross section. Further, the lower post member 28 is structured and disposed to accommodate sliding, telescoping receipt of the respective upper post member 30 therein. A plurality of spaced through holes 32 are provided on opposite sides of both the lower post members 28 and the upper post members 30, whereupon alignment of one or more of the through holes 32 of the upper post member 30 with one or more through holes 32 on the lower post member 28 facilitates insertion of a locking pin 33 therein, thereby selectively and adjustably positioning the upper post member 30 relative to the lower post member 28. In this manner, the overall height of the vertical post assemblies 26, 26' can be selectively adjusted in accordance with the desired use of the apparatus (as described more fully hereinafter) as well as the size of the individual using the apparatus. The top end of each upper post member 30 is provided with an enlarged head portion 34 which includes a receptacle 35 formed therethrough. The receptacle 35 of each upper post member 30 is specifically sized and configured for sliding, fitted receipt of a cross beam assembly 36.

The cross beam assembly 36 includes a pair of cross beam members 38, 38' each having inboard ends 40 and outboard ends 42. A coupling 44 is adapted for fitted receipt of the inboard ends 40 of each cross beam member therein, so that holes 45 in the coupling align with holes 43 inboard ends of the cross beam members receive locking pins to thereby secure the cross beam members 38, 38' to the coupling 44, in end to end relation along a common longitudinal axis. The joined cross beam members 38, 38' define a full length of the assembled cross beam assembly 36. As seen in several of the drawing figures, including FIGS. 1–4, the outboard ends 42 of the assembled cross beam assembly are adapted for fitted receipt within the receptacles 35 on the top ends of the upper post members 30. Holes 37 formed through the enlarged head 34 of each upper post member 30 align with through holes 47 of the cross beam members for receipt of locking pins 46 therethrough in order to secure the outboard ends of the cross beam assembly 36 within the receptacles so that the cross beam assembly spans between the vertical post assemblies 26, 26' in spaced relation above the floor surface. Adjustment of the upper post members relative to the lower post members, with the use of the locking pins 33 and aligned and spaced holes 32, enables selective positioning of the cross beam assembly 36 at a plurality of adjusted height positions above the floor surface to accommodate the needs of the user.

The primary frame structure 12 is specifically structured for removable attachment of a plurality of accessory components thereto. The plurality of spaced holes 32 on the upper and lower post members, as well as the holes 43, 47 and 49 on the cross beam members, provide means for removable attachment of the accessory components to the frame structure, using locking pins as previously described. The upper and lower post members are further provided with congruently configured and aligned elongate slots 50, 50' formed through the opposite inboard and outboard facing sides of the upper and lower post members to further facilitate attachment and adjustable positioning of accessory components thereto, as shown in FIG. 3.

Figure 27:
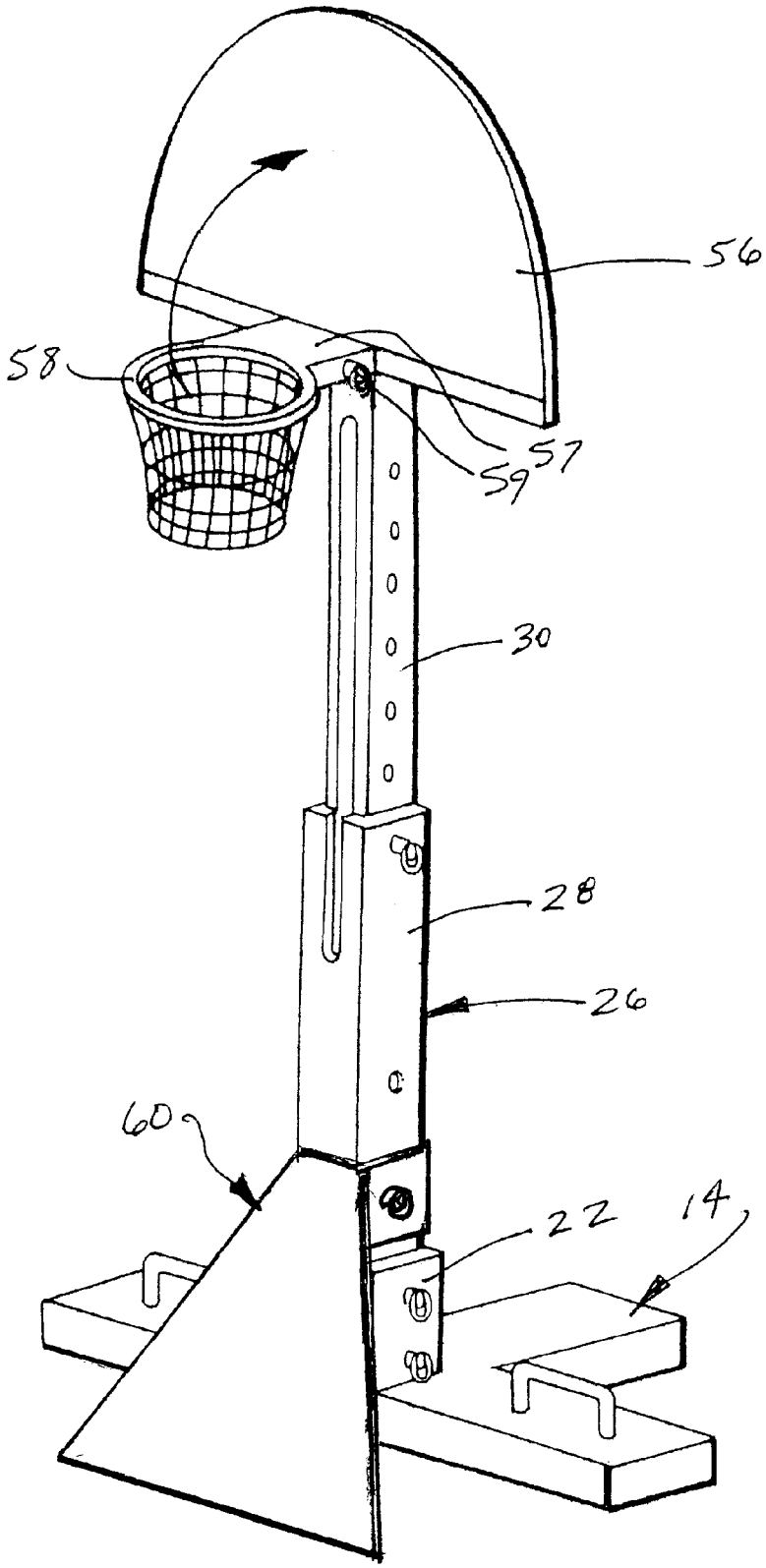
FIG. 27 is a front perspective view showing the primary frame structure of the multi-purpose training apparatus reconfigured to support a basketball backboard and rim.

Referring to FIG. 1, a heavy bag 52 is secured on an eye bolt 53 fitted to the coupling 44 so that the heavy bag is suspended from the cross beam assembly 36, midway between the vertical post assemblies 26, 26'. Additionally, a basketball backboard 56 and hoop 58 assembly is shown in FIGS. 1 and 27 fitted to the outboard facing side of the receptacle 35 on the top end of the upper vertical post member 30. Specifically, a mounting stub (not shown) extending from the rear face of the backboard 56 is sized and configured for congruent, sliding receipt within the hollow tubular structure of the receptacle 35 on the top end of the upper post member 30. In a preferred embodiment, the hoop 58 and plate 57 of the basketball assembly is pivotally fitted to the backboard 56 to permit collapsing of the hoop 58 against the front face of the backboard when not used, thereby facilitating ease of storage. When mounted in the operable position, as shown in FIG. 1, a locking pin 59 or other means may be employed to secure the hoop in the down, operable position for shooting a basketball therethrough. Additionally, an angled plate 60 is attachable to the lower post member 28, as shown in FIG. 27, to assist in returning a basketball to a shooter after making a basket.

Figure 6:
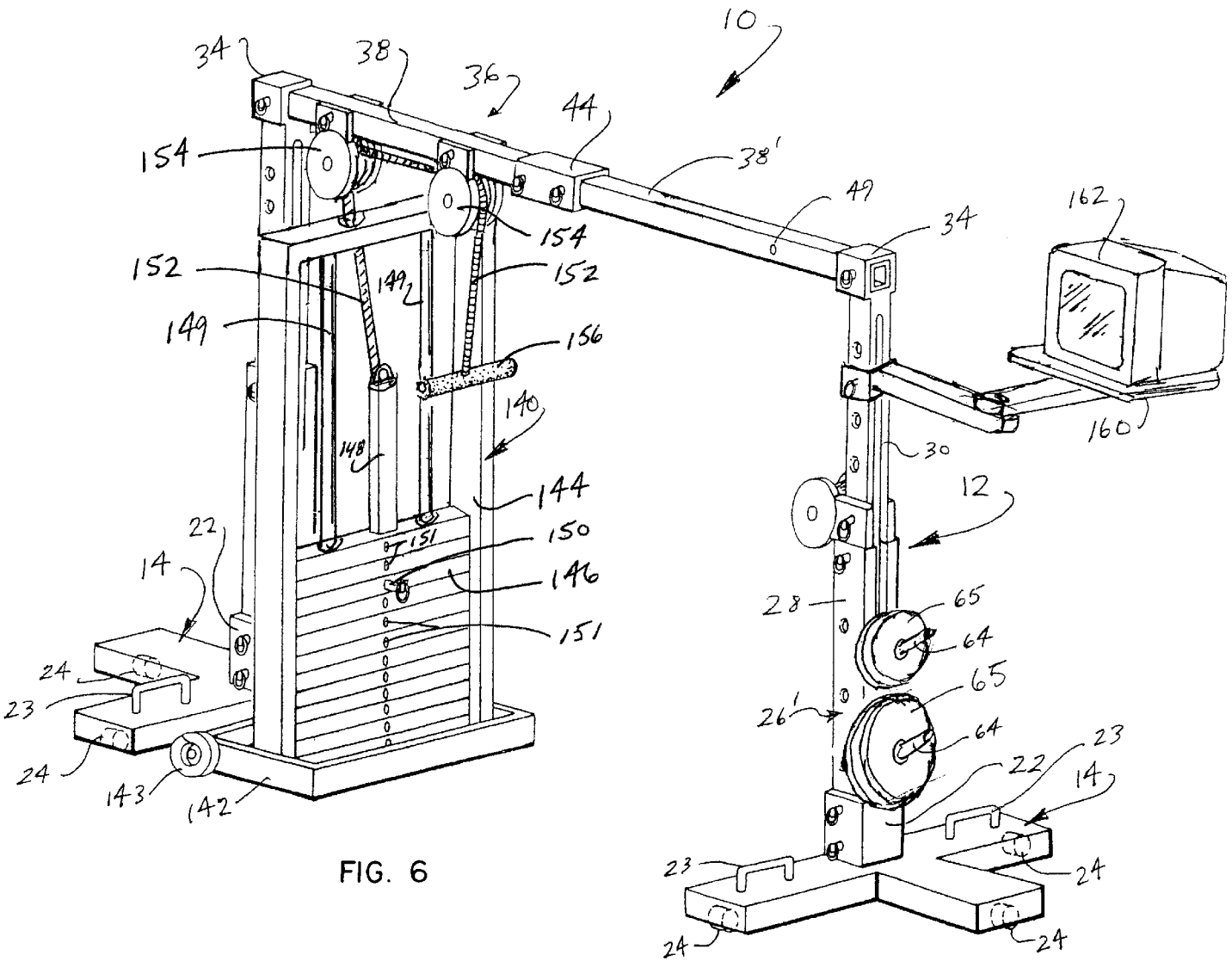
FIG. 6 is still another perspective view of the multi-purpose training apparatus, with the primary frame structure shown in a fully assembled condition and a weight training apparatus and components attached thereto.

The lower post members 28 are further provided with holes 63 or other means to accommodate removable attachment of pegs 64 to support weight lifting plates 65 thereon. Specifically, weight lifting plates 65 of the type commonly used on bar bells and dumbbells, can be stacked on the pegs 64, as seen in FIG. 6. This further helps to stabilize the frame structure 12 in the upright, assembled position by providing a lower center of gravity near the base members, thereby reducing a tendency of tipping of the assembled structure.

Figure 3:
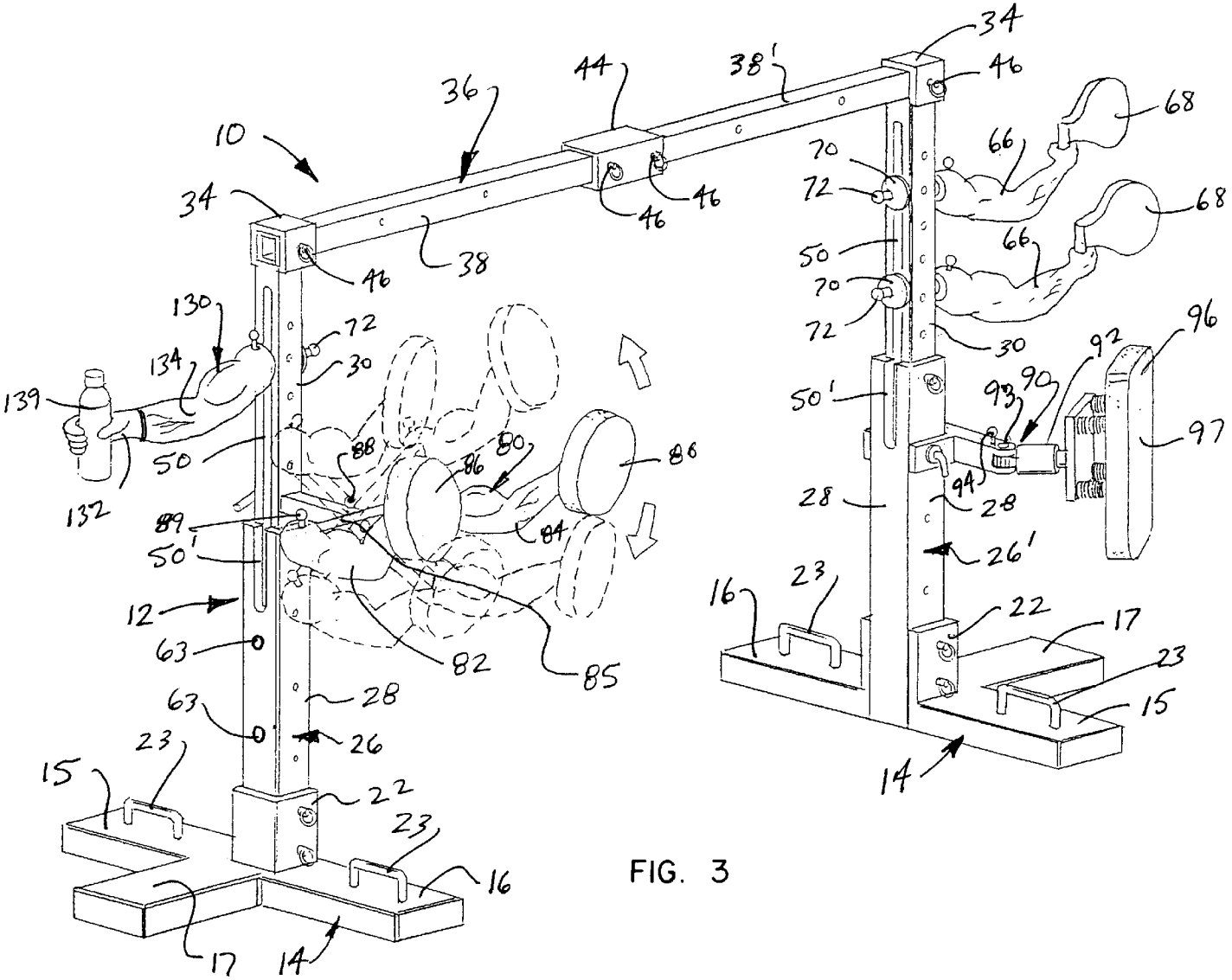
FIG. 3 is a perspective view of the multi-purpose training apparatus, showing the primary frame structure in an assembled condition with various component training devices attached thereto.
Figure 4:
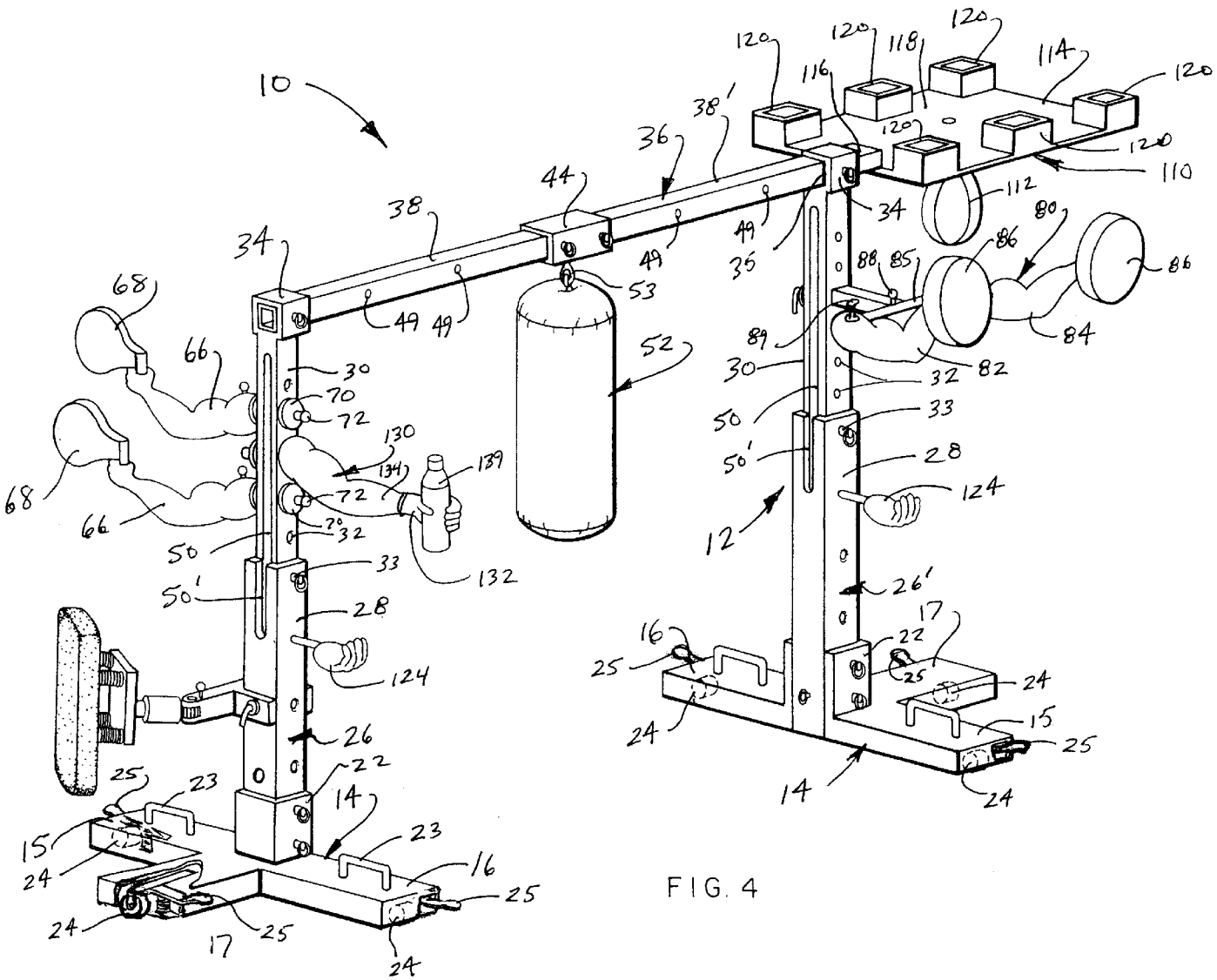
FIG. 4 is yet another perspective view of the multi-purpose training apparatus, shown in a fully assembled condition with still further training accessory components attached thereto.
Figure 8:
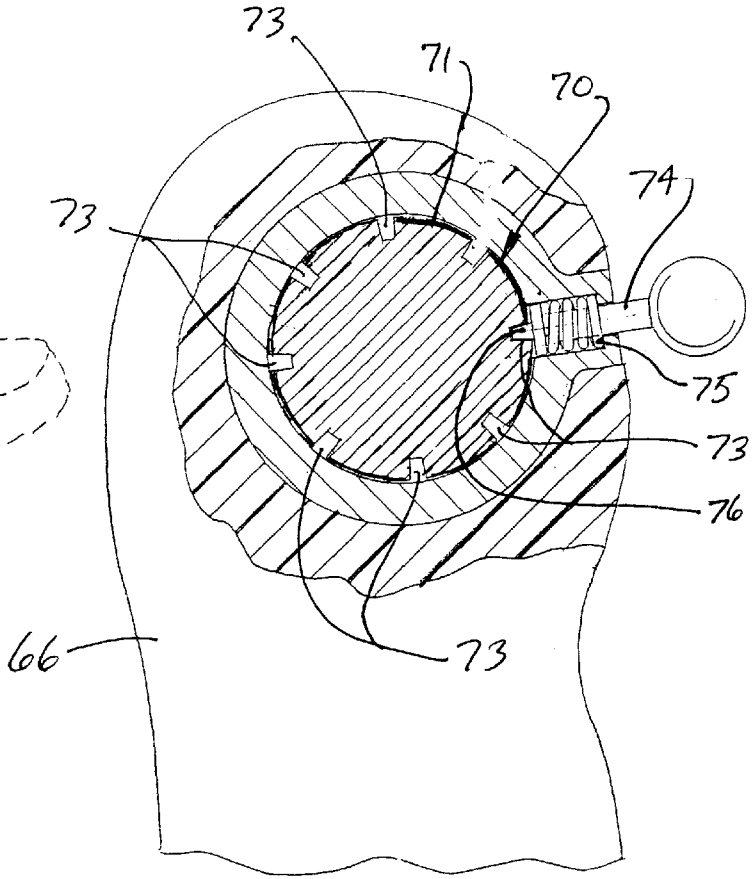
FIG. 8 is an isolated view, shown in partial section, illustrating an adjustable locking device used in conjunction with the arm structure and target pad of the accessory component of FIG. 7.
Figure 7:
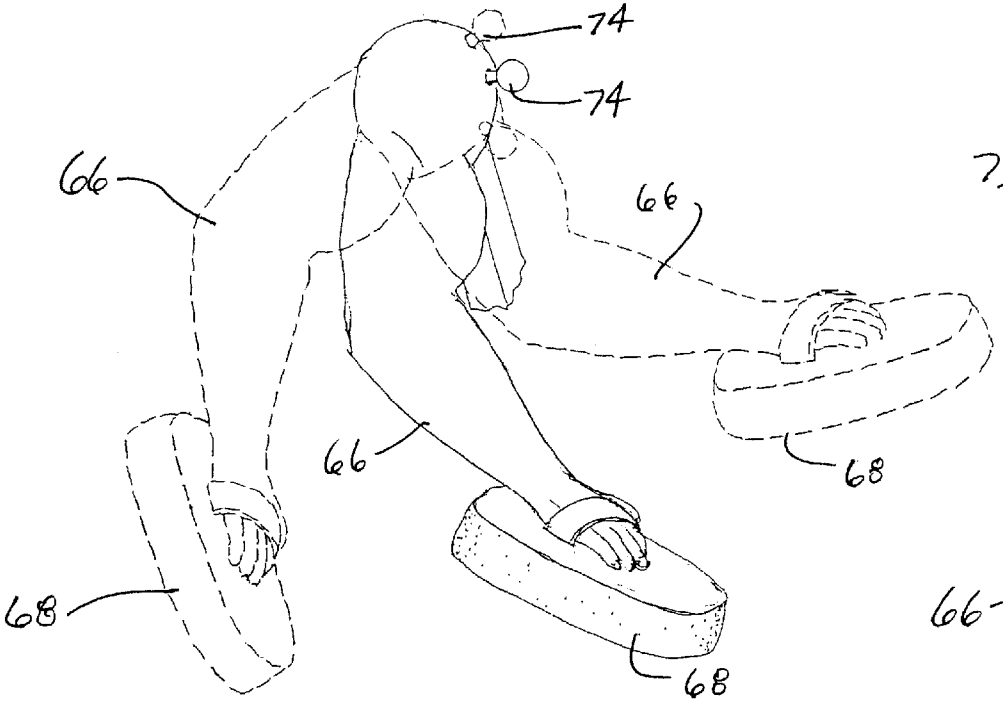
FIG. 7 is a side elevational view showing adjustable movement of a component accessory device comprising an adjustable arm structure and target pad.

Referring to FIGS. 3 and 4, the accessory components further include a plurality of arm members 66 with target pads 68 for training in boxing and the martial arts. In a preferred embodiment, the arm members 66 are formed and configured to resemble a muscular human arm. The arm members 66 can be secured to the upper and/or lower post members 28, 30 by mounting through the elongate slots 50, 50' or through any of the respective aligned through holes 32. Mounting within the elongate slots 50, 50', as shown in FIG. 3, permits easy selective adjustment of the height of the arm members 66, by sliding the mounting structure 70 of the arm member 66 within the elongate slot until the desired height is reached. The mounting structure 70 includes a through bolt 71 and handle means 72 for locking attachment to the frame structure 12. An opposite end of the through bolt 71 is anchored within the arm member 66 in a manner which enables the arm member 66 to rotate thereabout. The through bolt 71 includes notches 73 for locking receipt of a spring loaded pin 74, thereby enabling adjustable rotation of the arm 66 at fixed positions about the through hole 32 or slots 50, 50', as shown in FIGS. 7 and 8. Specifically, pulling outwardly on the pin 74 against the force of the spring 75, frees the distal end of the pin 74 from one of a plurality of notches formed about the through bolt of the mounting device. This permits rotation of the arm member 66 about the mounting device and frame structure of the apparatus until the desired positioning of the target pad 68 or other device on the opposite end of the arm structure is achieved. When in the desired position, the pin 74 is released, allowing the spring 75 to urge the distal end 76 of the pin 74 inwardly against the through bolt 71 while rotating the arm 66 slightly to ensure that the distal end 76 of the pin sits within one of the notches.

Referring to FIGS. 3 and 4, the accessory components further include a dual arm assembly 80 including a pair of arm members 82, 84 extending from a separation bar 85, wherein each of the arm member 82, 84 includes a target pad 86 fixed to an end thereof. The arm members 82, 84 are rotatable about a central axis extending through the center of the separation bar 85 to selectively adjust the target pads 86 at a plurality of angular, adjusted positions. A spring loaded locking pin 88 is provided for releasably locking the cross bar 85 about the pivotal axis at the selected positions. Further, each of the arm members 82, 84 is individually rotatable relative to one another and the separation bar, using a spring loaded locking pin 89 and mounting structure of the type shown in FIG. 8.

Figure 14:
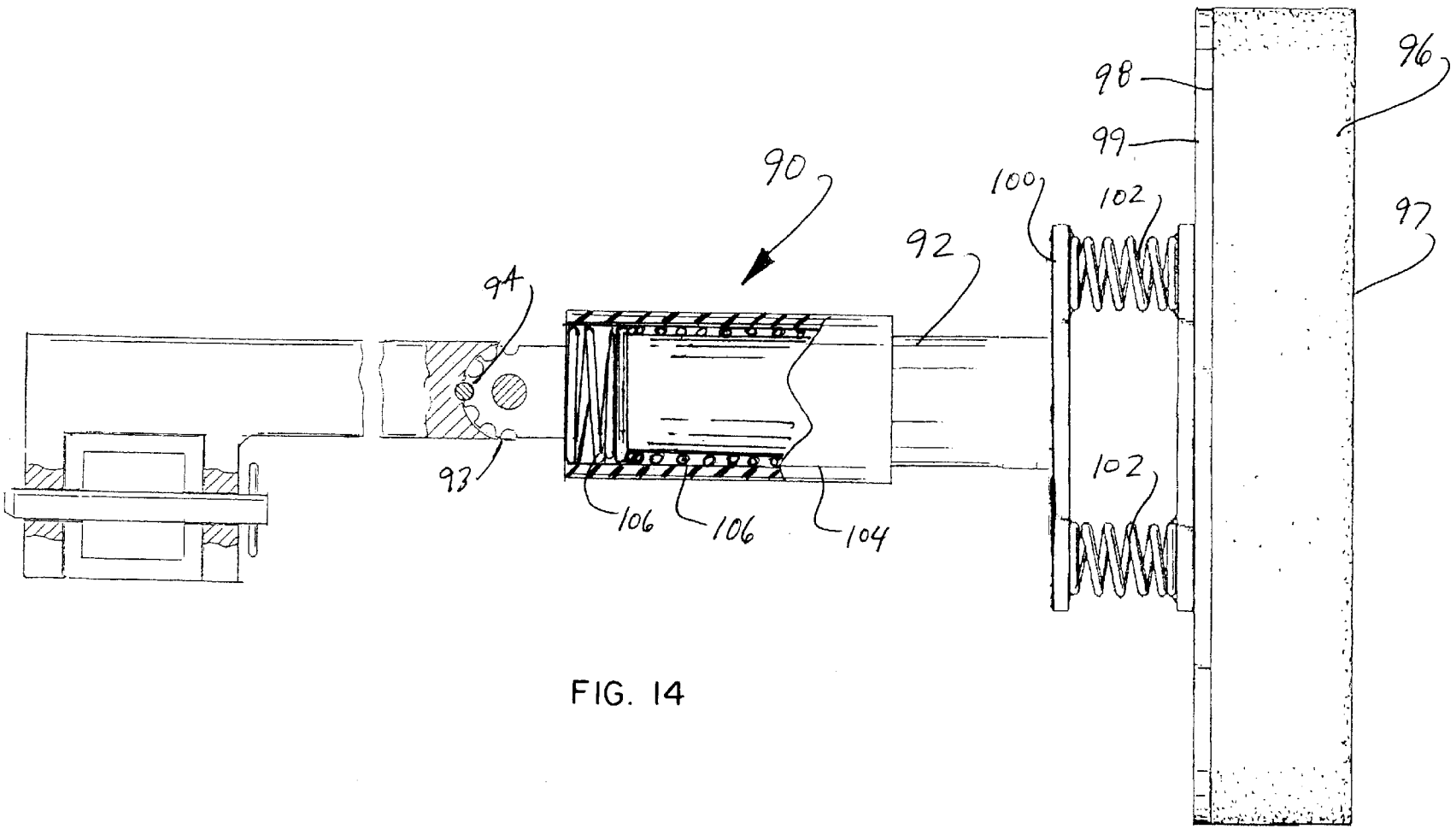
FIG. 14 is an isolated view of a spring biased target pad assembly for use as an accessory component on the frame structure.

Referring to FIGS. 3 and 14, a spring biased target pad assembly 90 is shown. The spring biased target pad assembly 90 provides a further accessory component for practicing punches and kicks in training for both boxing and the martial arts. The spring biased target pad assembly includes an arm member 92 having an elbow portion 93 with means 94 for selectively adjusting an angle of the arm member 92 at the elbow portion 93 at a plurality of fixed, adjusted angular positions. The target pad assembly further includes a foam pad covered 96 with a protective lining, such as canvas or vinyl, and having an outer face 97 positioned and disposed for striking with the hands or feet. The rear side 98 of the pad 96 may be reinforced with a plastic or metal sheet 99 and is connected to a mounting plate 100 with a plurality of springs 102. The arm member is further provided with a telescoping structure 104 and spring means 106 therein. Both the springs behind the pad and within the telescoping arm structure provide a shock absorbing means for absorbing impact of punches and kicks which strike the target pad 96. This helps to minimize stress on both the frame structure 12 as well as the bones, muscles and joints of the person striking the pad, thereby reducing the likelihood of injury.

Referring to FIG. 4, a speed bag assembly 110 includes a speed bag 112 secured to a mounting plate 114 with a conventional swivel mounting (not shown), as commonly used on speed bags for training and boxing in the martial arts. The mounting plate 114 includes a stub portion 116 which is adapted for fitted, locking receipt within the receptacle 35 and hollow cross arm member 38, 38' on the top end 34 of the upper post member 30, so that the mounting plate 114 extends outwardly from a side of the frame structure 12, as seen in FIG. 4. The bottom side of the mounting plate 114 is specifically structured for mating contact with the speed bag 112 so that the speed bag bounces off of the flat surface of the bottom side of the mounting plate without obstruction or damage, in a conventional manner. The opposite upper side 118 of the mounting plate 114 is provided with a plurality of receptacles 120 for receipt of the top ends of both the lower post members 28 and the upper post members 30, as well as the cross beam members 38, 38', when assembled as a cart, as described more fully hereinafter in conjunction with FIG. 23.

Referring to FIGS. 1 and 4, the apparatus is further provided with removable hand members 124 which are fitted through the holes 32 of the vertical post members to serve as a cradle to support a barbell in spanning relation between the vertical post assemblies. In this manner, a user may perform bench press exercises with a barbell, while lying on a bench 126, as seen in FIG. 1.

Figure 11:
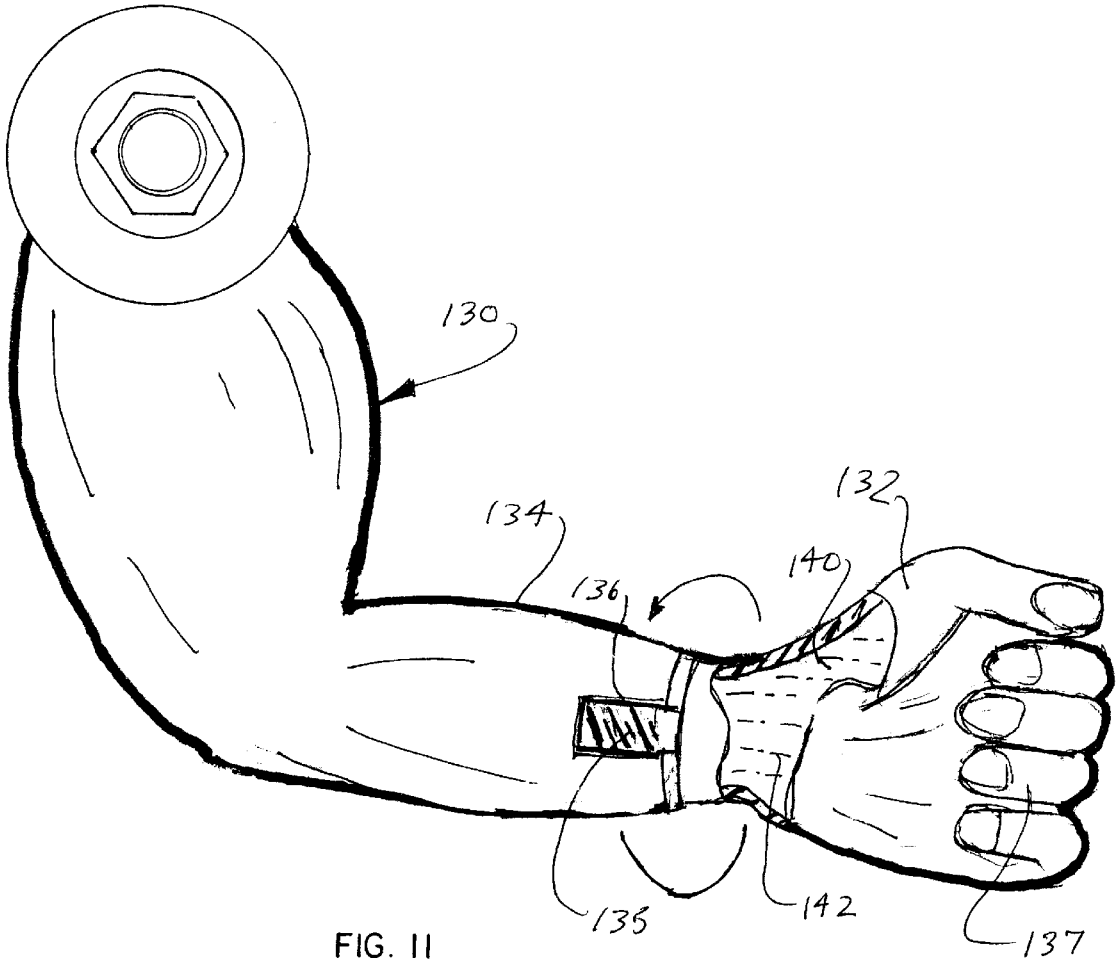
FIG. 11 is an isolated view, in partial section, showing a beverage holder and cooler accessory.

Referring to FIGS. 3, 4 and 11, a further accessory component of the invention includes an arm member 130 formed and configured in the shape of a muscular human arm and including a removable hand portion 132 which threadably attaches to a remainder of the arm portion 134 via a threaded stud, bolt, or like member 135 fixed to the hand portion and extending therefrom for threaded receipt within a threaded axial bore 136 formed in the forearm portion 134. The hand portion 132 is specifically shaped and configured so that the fingers 137 curl to support a beverage can 139 or cup therein. Further, the hand portion 132 includes an internal chamber 140 filled with a freezable substance 142 so that the hand portion can remain cold for a period of several hours after being placed in the freezer. Specifically, the hand portion 132 can be removed from the arm portion 134 and placed in a freezer for 12 hours until the cooling substance within the hand portion freezes. Thereafter, the hand portion can be removed from the freezer and attached to the arm portion on the frame during a workout session, with the hand portion 134 serving to support and maintain a beverage cool throughout the workout session. The arm member 130 is mounted to the frame structure in the same manner as shown and described in connection with the arm members 66, above.

FIG. 6 illustrates use of a weight lifting apparatus 140 in conjunction with the frame structure. Specifically, the weight lifting apparatus 140 includes a base frame structure 142 with two or more wheels 143 fitted thereto. An upstanding structure 144 accommodates a plurality of weight elements 146 in a stacked array. Specifically, the upstanding portion includes a central post 148 extending through each of the plurality of weight elements and guide posts 149 on opposite sides of the center post, thereby permitting the weight elements to be raised and lowered while remaining in the stacked array. A locking pin 150 is selectively positionable through holes 151 of the weight elements 146, to thereby permit selection of the amount of weight elements to be lifted, in a manner commonly known in conventional weight lifting machines of this nature. A cable 152 extending from the stack of weights can be selectively secured about one or more pulleys 154 fixed to the frame structure 12. In this manner, a user can grasp a handle 156 on the opposite end of the cable 152 and pull in a particular direction, depending upon placement of the pulleys 154, in order to lift a selected amount of weight on the stack of weight elements 146 to thereby exercise and build a wide range of muscle groups on the arms, legs and torso of the user. The wheels 143 on the base structure 142 of the weight lifting apparatus 140 facilitate transport and movement of the weight lifting apparatus 140 to and from the frame structure 12. Thus, when it is desired to attach other components, the weight lifting apparatus 140 can be conveniently wheeled out of the way so that it does not obstruct use of other accessory components attached to the frame structure 12.

With further reference to FIG. 6, a pivotal platform support 160 is removably attachable to the frame structure for supporting a television 162, computer monitor, or the like thereon so that the user can watch a television program, videotape or the like during a workout session.

Figure 15:
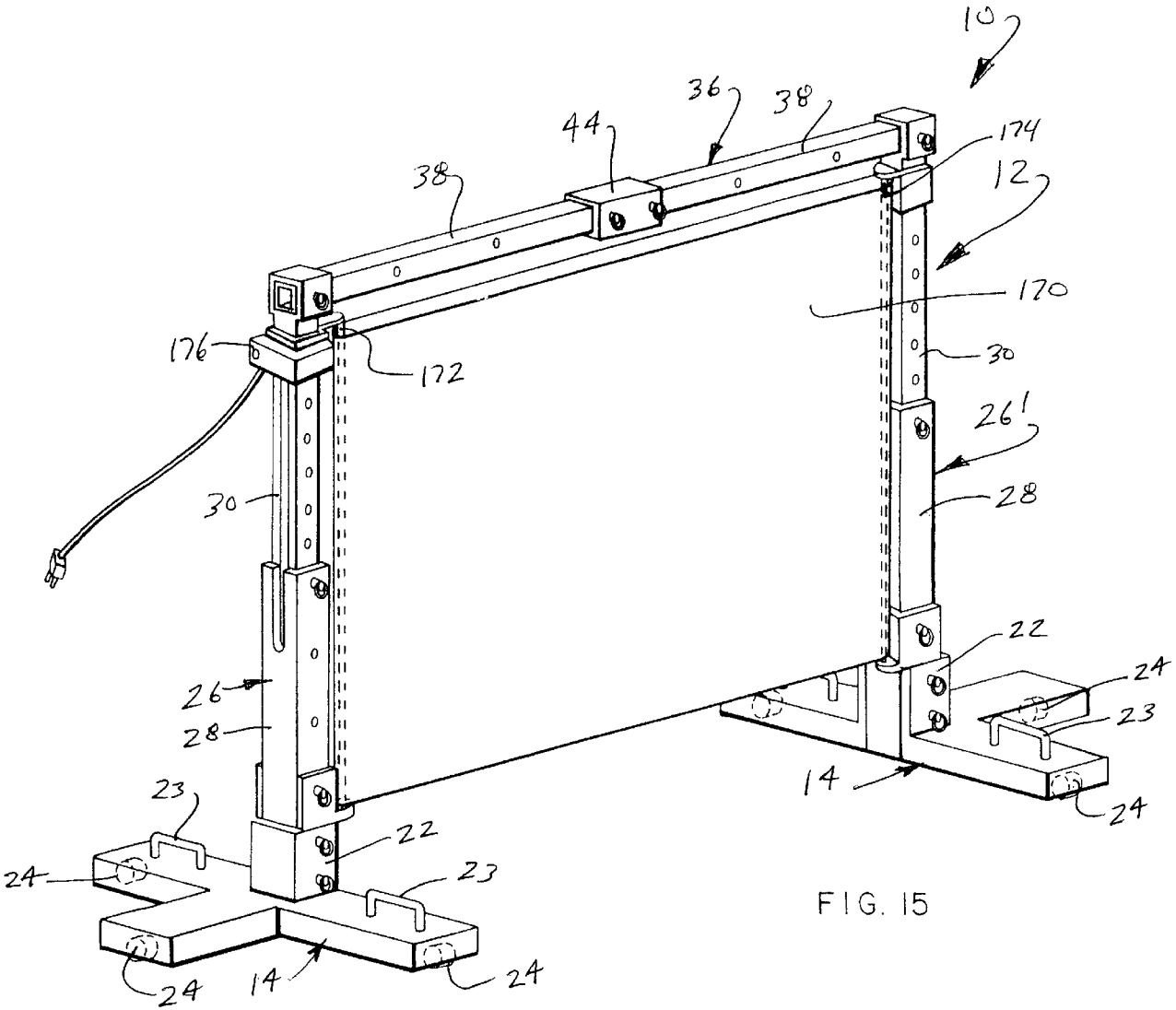
FIG. 15 is a perspective view of the primary frame structure of the present invention shown in a fully assembled condition with a motorized, moving hunting target back drop attached thereto.

FIG. 15 shows yet another accessory component attached to the erected frame structure. Specifically, a target back drop panel 170 is mounted on opposite rollers 172, 174 secured to the vertical post assemblies 26, 26'. An electrically powered motor 176 attachable to one of the post assemblies 26 drives one of the rollers 172 to thereby move the target backdrop panel 170 so that objects printed on the panel move across the area between the vertical post assemblies 26, 26'. In this manner, the user can practice shooting with a laser gun or other target practice weapon as the targets move from one side to the other.

Figure 10:
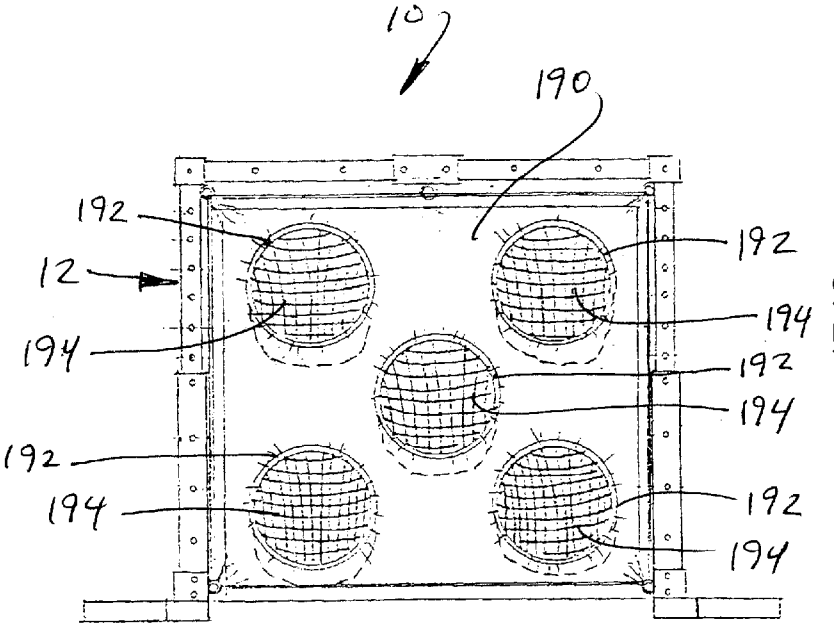
FIG. 10 is a front elevational view showing the primary frame structure of the multi-purpose training apparatus in a fully assembled condition with a football training target component attached thereto.
Figure 9:
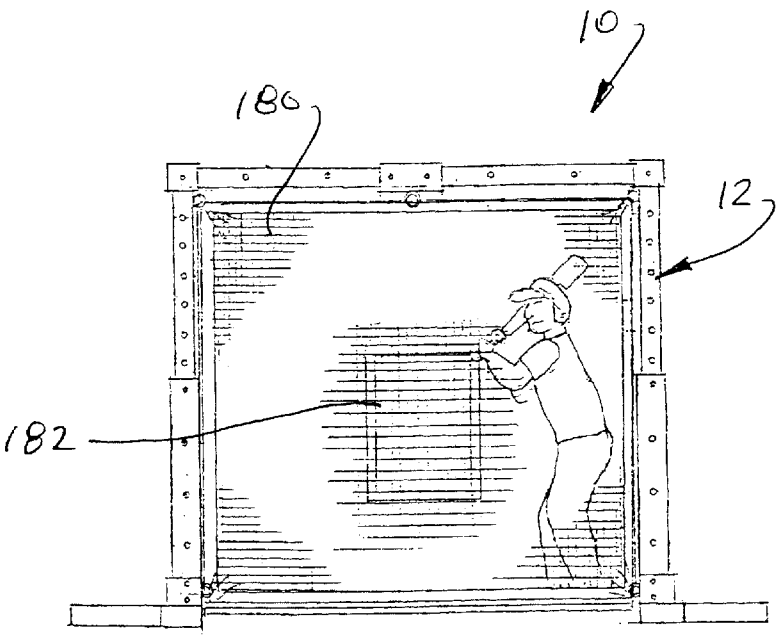
FIG. 9 is a front elevational view showing the primary frame structure of the multi-purpose training apparatus in a fully assembled condition with a baseball training back drop attached thereto.

It is important to note that the frame structure 12 can be assembled in a variety of configurations in accordance with the desired use of the apparatus 10. Several examples of different configurations and uses are shown in the drawing figures, as described more fully hereinafter. Specifically, FIGS. 9 and 10 show the frame structure 12 assembled in the same general configuration as shown in the previously described figures, with a full panel device mounted thereto. Specifically, FIG. 9 shows a backdrop panel 180 with a strike target zone 182 thereon to practice pitching in the sports of baseball or softball. FIG. 10 shows a full panel assembly 190 having a plurality of openings 192 therethrough with net pockets 194 secured to a rear side. The openings 182 are ideally sized for receipt of a football therethrough, wherein the football, once passing through the opening, is caught within the net pocket 194. This particular accessory is useful for practicing passing a football.

Figure 12:
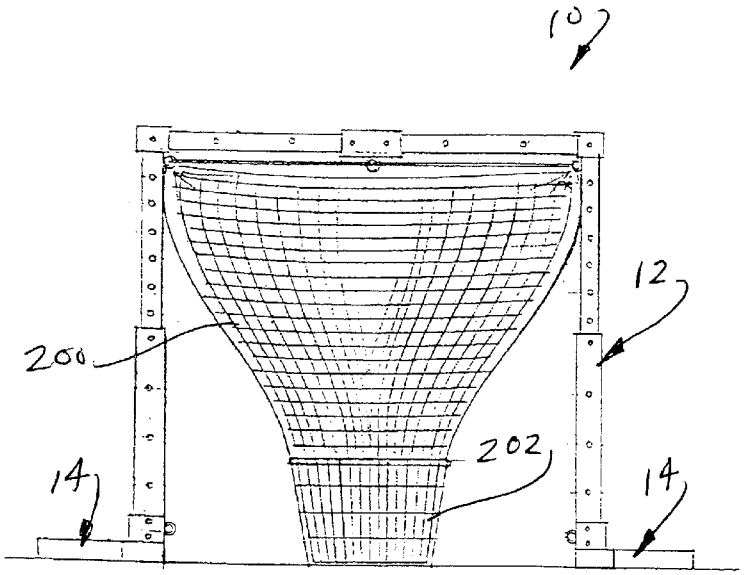
FIG. 12 is a front elevational view showing the primary frame structure of the multi-purpose training apparatus in a fully assembled condition with a golf and tennis training component attached thereto.

FIG. 12 illustrates the frame assembly 12 assembled and supporting a catch net 200 which extends downwardly to a basket 202. In this particular embodiment, the catch net 200 is specifically structured and configured to form a funnel-like structure downwardly to the basket 202 so that balls or other objects which are caught by the net 200 are directed downwardly into the basket 202. This catch net assembly is particularly useful for practicing tennis and golf, wherein balls which are hit into the net are conveniently collected into the basket 202.

Figure 13:
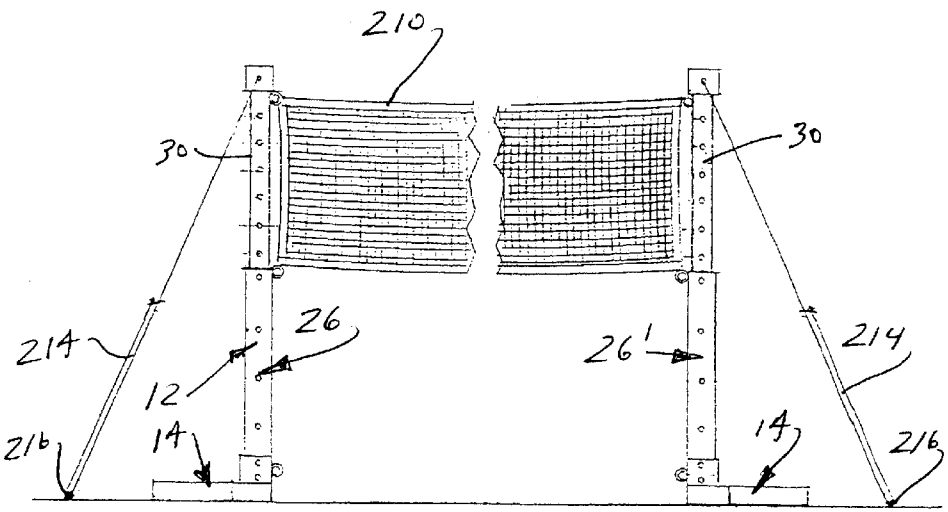
FIG. 13 is a front elevational view of the base and vertical posts of the primary frame structure shown assembled and secured with anchoring cords with a volleyball net spanning therebetween.

FIG. 13 shows the frame structure 12 erected in a manner which supports a volleyball net 210. Specifically, the vertical post assemblies 26, 26' are supported in spaced relation so that the volleyball net 210 can be secured to the upper vertical post members 30 and pulled taut therebetween, so that the volleyball net 210 is maintained extended there across in a conventional manner. It may be necessary to use tie down cords or cables 214 secured to stakes 216 driven into the ground, as shown in FIG. 13, in order to stabilize the vertical post assemblies 26, 26' and maintain the volleyball net 210 in the extended, taut configuration.

Figure 16:
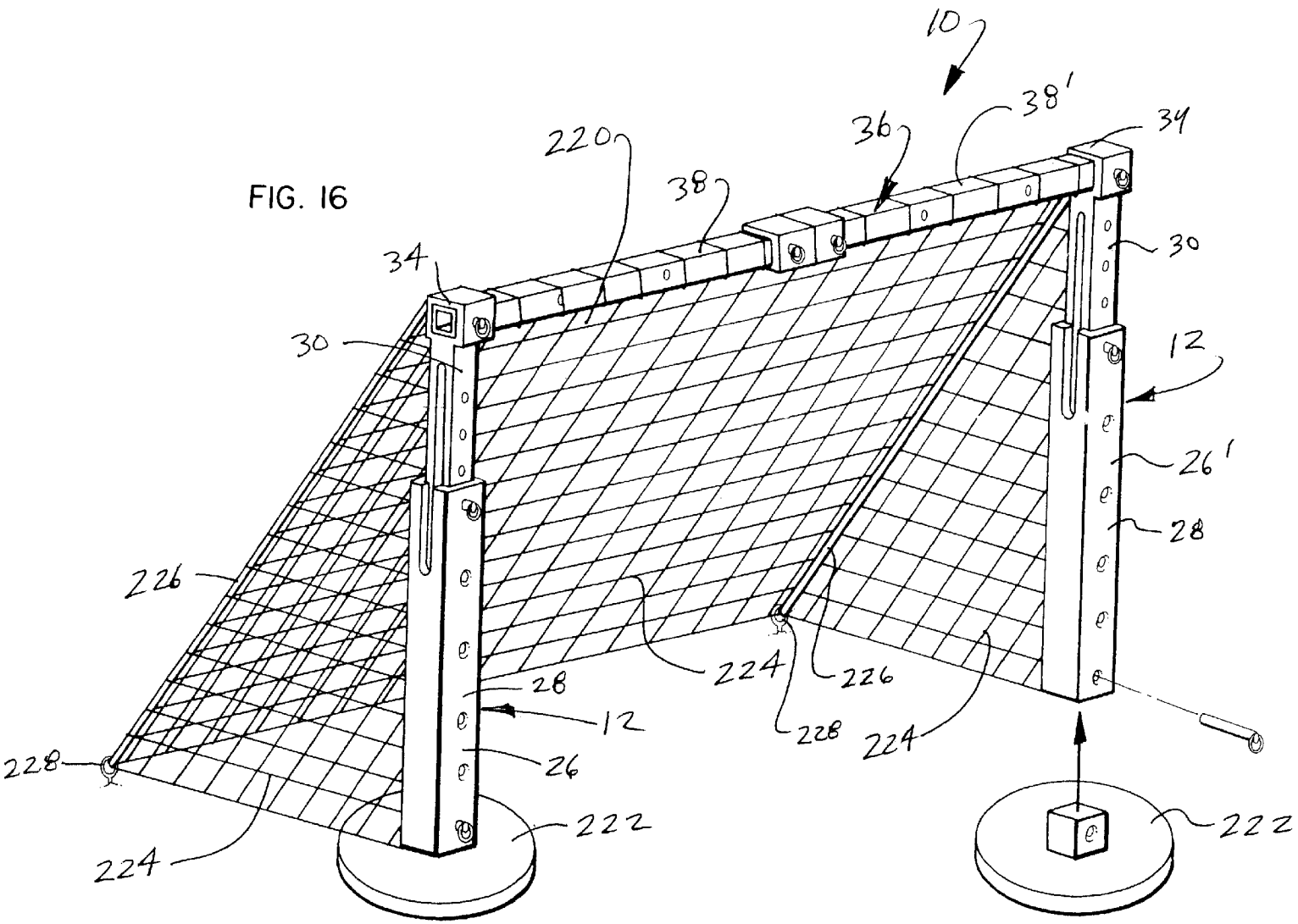
FIG. 16 is a front perspective view showing the primary frame structure of the multi-purpose training apparatus reconfigured to provide a soccer goal.

FIG. 16 illustrates assembly of the frame structure 12 in a configuration to provide a soccer goal 220. In this particular embodiment, circular flat base plates 222 may be provided in lieu of the T-shaped base members 14 to avoid possibility of injury which may result from tripping on the feet extensions of the T-shaped bases. As previously described, the upper post members 30 are selectively adjustable relative to the lower post members 28, to thereby enable adjustment of the height of the cross beam assembly 36 above the floor or ground. In this manner, the size of the soccer goal 220 can be adjusted in accordance with the age of the users. For example, for small children, the cross beam assembly 36 would be positioned at a lower height to reduce the size of the soccer goal 220 opening and the height of the cross beam assembly 36 above the ground. Older children and adults can extend the upper post members 30 to raise the height of the cross beam assembly 36, thereby enlarging the size of the goal 220 opening, depending upon the level of the skill of the players. The net 224 is secured about the frame structure 12 and hardware can be provided for receipt within the holes on the vertical post assembly and horizontal post assembly. It is further useful to use anchoring cords or cables 226 extending from the rear top end 34 of the upper post members 30 to stakes 228 driven into the ground, in spaced relation behind the base members. The cords or cables 226, anchored to the ground, help to prevent tipping of the frame structure 12 while also providing a means to maintain the shape of the net 224 in the desired configuration shown in FIG. 16.

Figure 17:
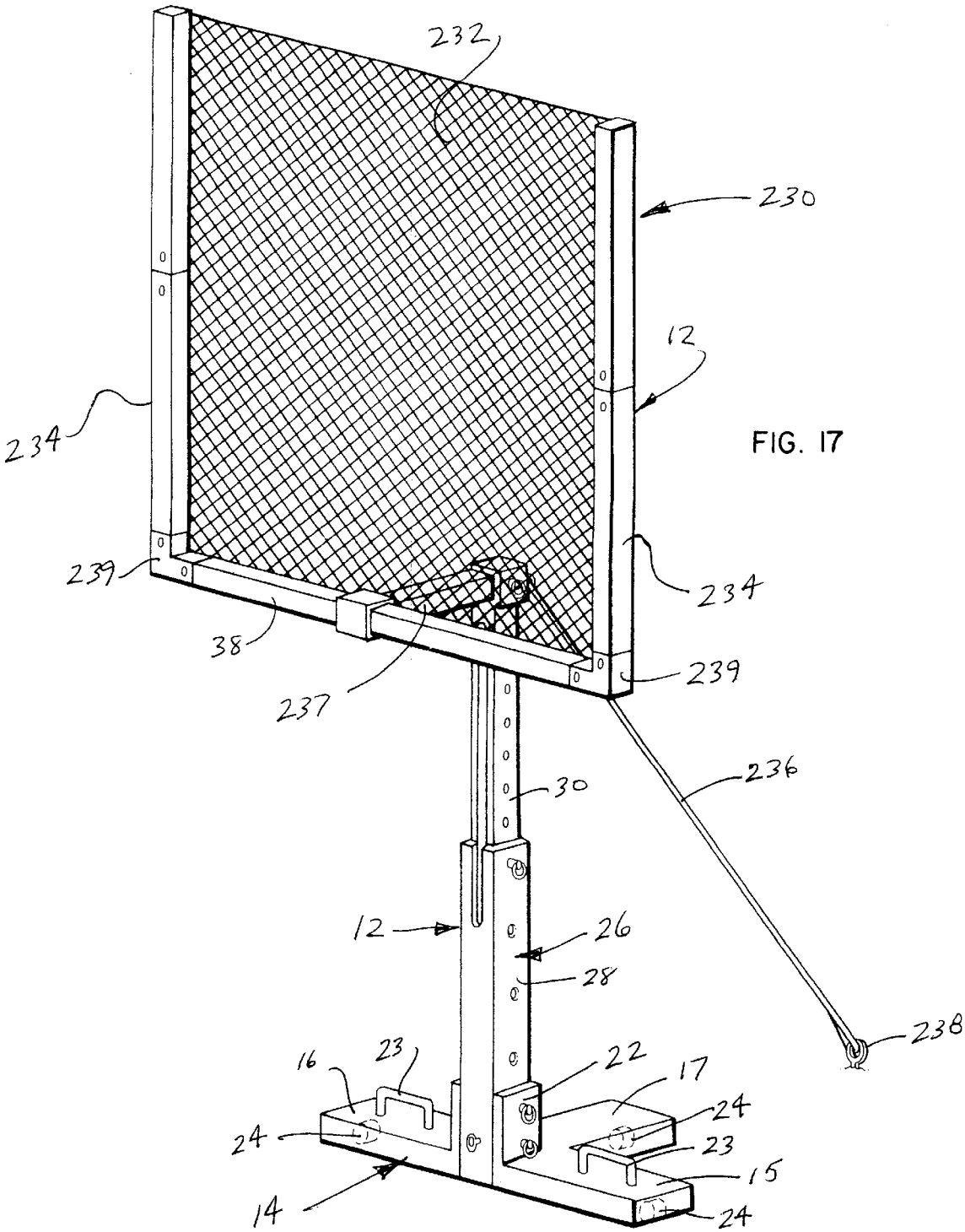
FIG. 17 is a front perspective view showing the frame structure of the multi-purpose training apparatus reconfigured to provide a football field goal.
Figure 18:
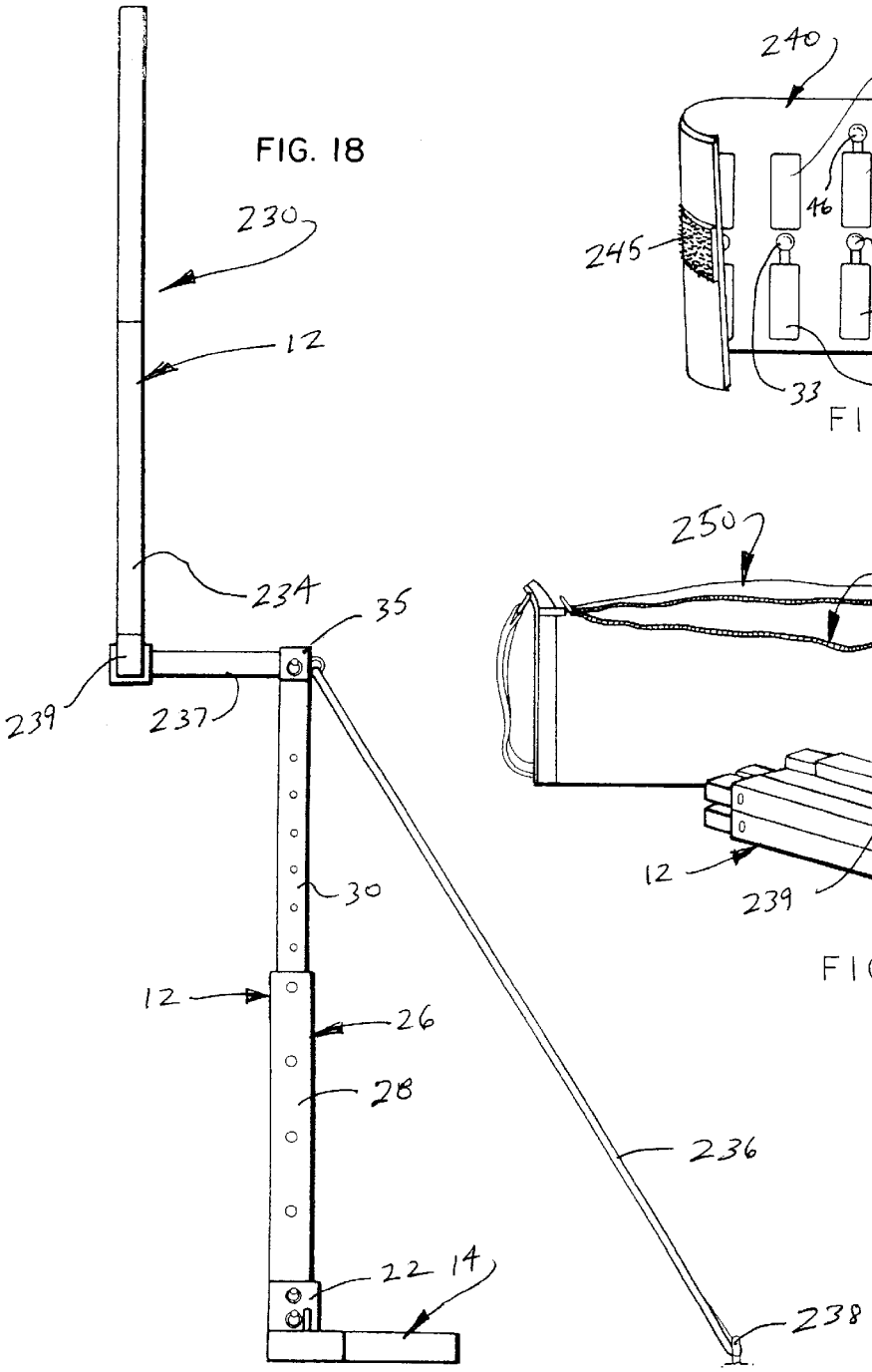
FIG. 18 is a side elevational view of the football field goal of FIG. 17.

FIGS. 17 and 18 illustrate the frame structure 12 assembled and arranged in a configuration to provide a football field goal 230. Similar to the soccer goal, an anchoring cord or cable 236 can be secured to a stake 238 driven into the ground, to thereby prevent tipping of the assembled field goal structure 230. A net 232 may be secured between the uprights 234 of the assembled goal post structure 230 to catch a football kicked between the uprights to facilitate visualization of a scoring kick which passes between the uprights, as opposed to a missed kick which passes outside of the uprights. The net 232 further helps to catch the football so that the user does not have to travel as far to retrieve a kicked field goal which passes through the uprights 234. Again, the upper post member 30 can be selectively adjusted relative to the lower post member 28 to vary the height of the horizontal cross beam 38 and uprights 234 relative to the ground surface. Corner connection adaptors 239 are provided to secure the uprights 234 to the ends of the horizontal cross arm member 38. Additionally, an extension post 237 is provided for interconnection between the cross arm member 38 and receptacle 35 on the upper vertical post member 30.

Figure 19:
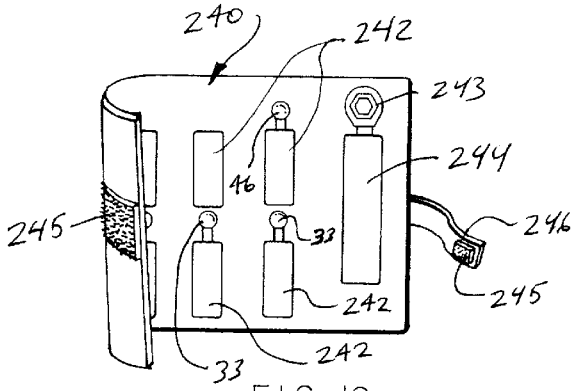
FIG. 19 is a top perspective view of a tool and parts assembly kit for use in assembling and disassembling the frame structure and attachable components.
Figure 20:
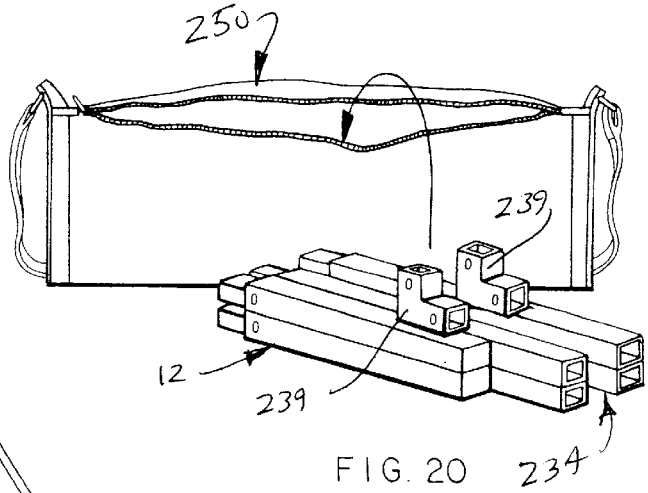
FIG. 20 is a side perspective view of a transport bag for accommodating the disassembled parts of the frame structure and various components.

FIG. 19 shows a tool pouch 240 which includes pockets 242 for accommodating placement of the locking pins 33, 46 used for assembly of the frame structure and attachment of various accessory components thereto. The tool pouch may further have means 244 for accommodating one or more tools 243, such as a ratchet wrench, to facilitate assembly of the apparatus. The tool pouch 240 is designed to be conveniently roller up and secured with a hook and loop fastener 245 and strap 246 to thereby enable ease of storage and placement within a carry bag 250 shown in FIG. 20. The carry bag can be used to carry pieces of the frame structure 12 and/or any of the component accessories as described above.

Figure 21A:
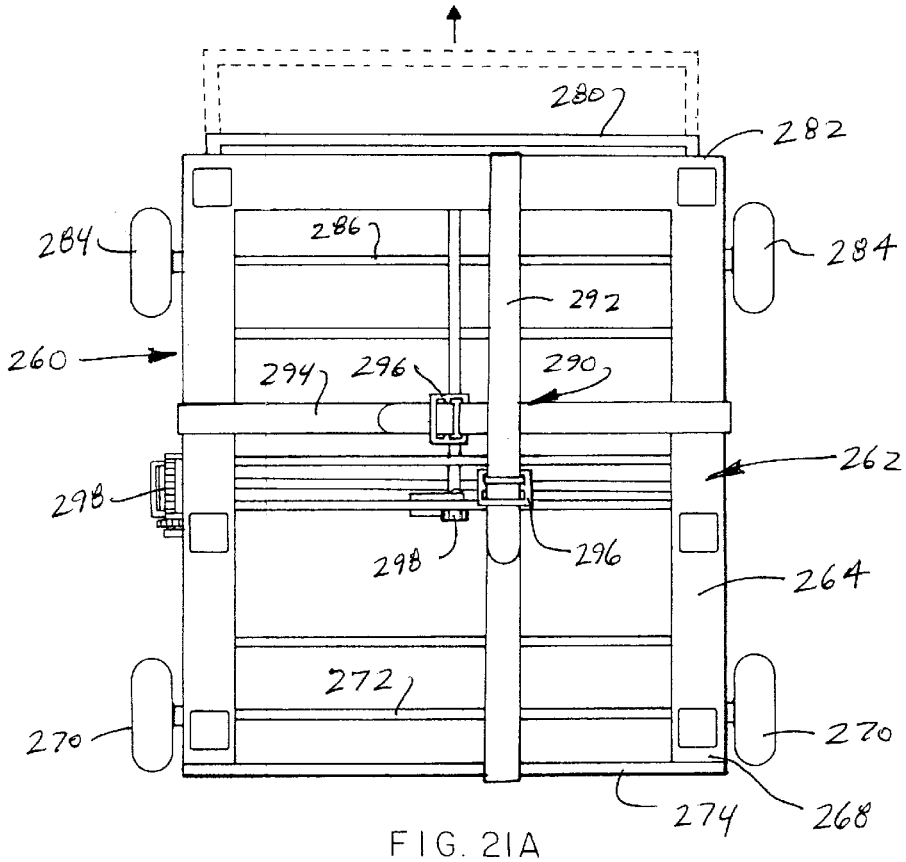
FIG. 21A is a top plan view of a dolly used in conjunction with the apparatus of the present invention.
Figure 22:
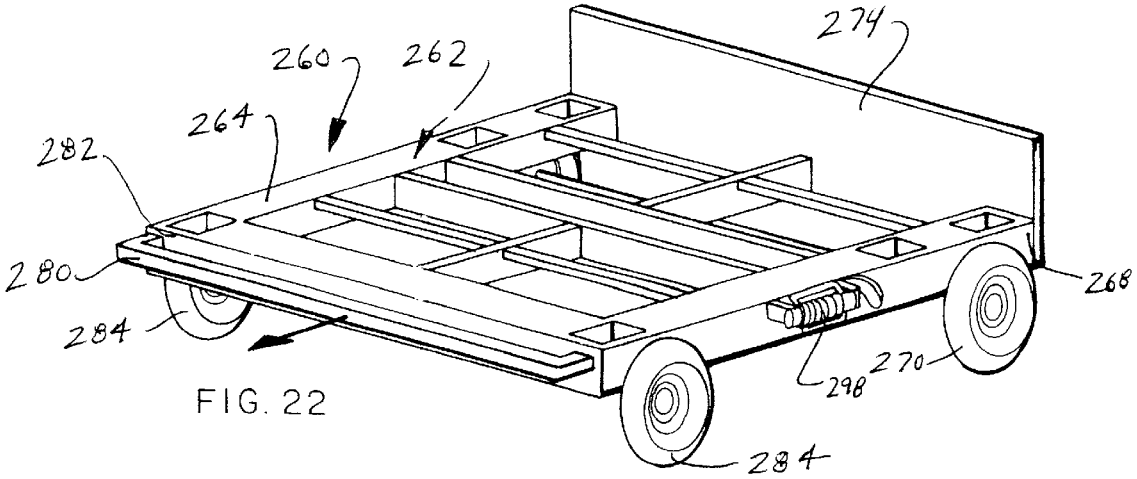
FIG. 22 is a perspective view of the dolly.
Figure 21B:
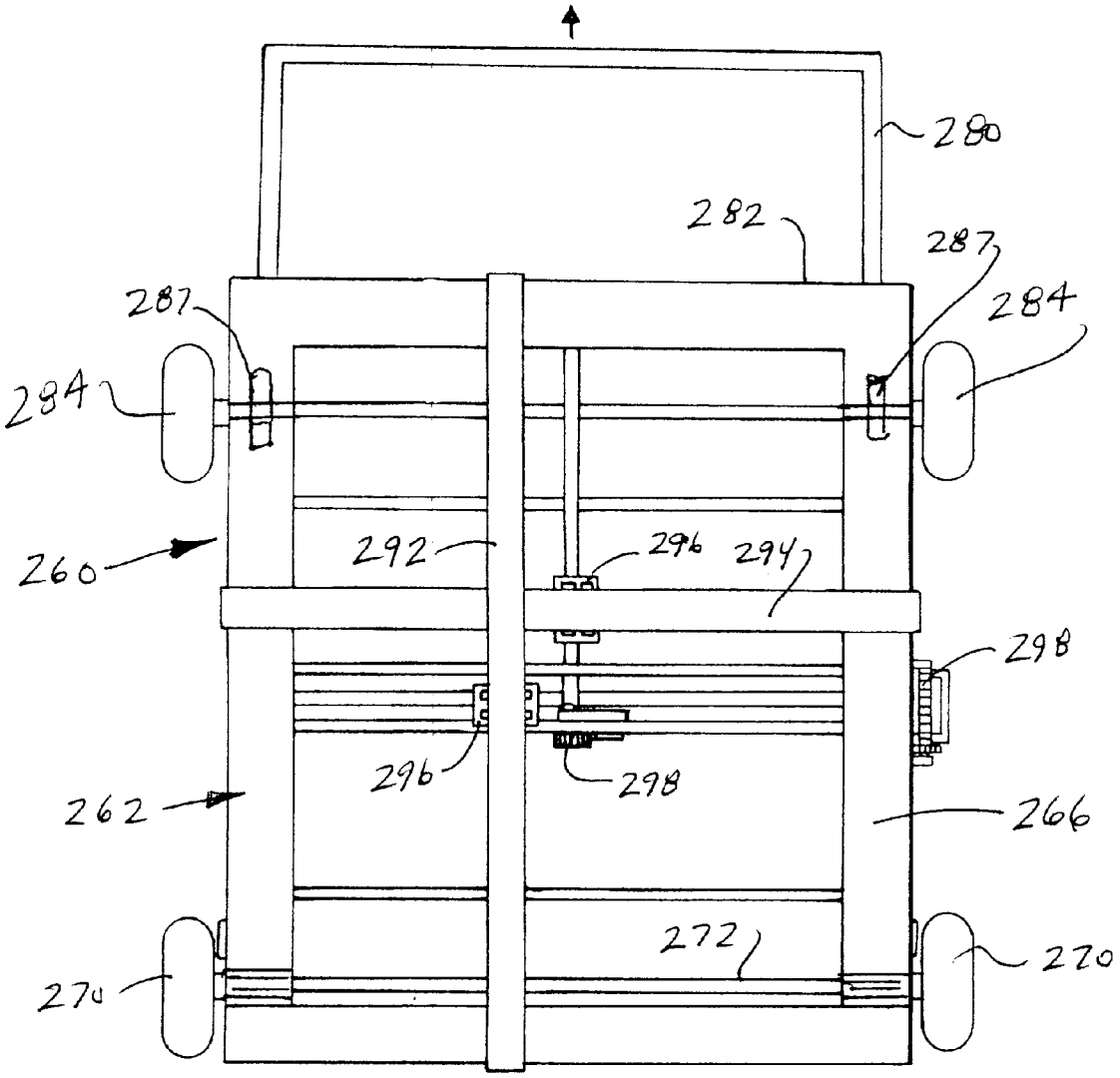
FIG. 21B is a bottom plan view of the dolly of FIG. 21A.

Referring to FIGS. 21A–23, a dolly 260 is shown for use in conjunction with the frame structure 12 and accessory components. Specifically, the dolly 260 can be used independently of the frame structure and accessory components in a conventional manner to move large objects, such as refrigerators, filing cabinets, and the like. Additionally, the dolly 260 can be used to carry and transport the apparatus 10, when disassembled. The dolly 260 includes a frame structure 262 defining a chasse including a top side 264 and a bottom side 266. A first set of wheels 270 is rotatably fixed on an axle 272 at a first end 268 of the chassis, adjacent a support plate 274. The support plate 274 extends from the first end 268 of the chassis 262 in generally perpendicular relation thereto and is used to support objects carried on the dolly 260, when used as a hand truck. An extendible handle 280 is movably fitted to a second end 282 of the chassis 262 and is operable between an extended position and a collapsed position, as shown in FIGS. 21A and 21B. Specifically, in the extended position, as seen in FIG. 21B, the handle 280 is useful when the dolly 260 is operated as a handle truck to carry articles such as a refrigerator, filing cabinets and the like thereon. The handle 280 can also be retracted, as shown in FIGS. 21A and 22, so that the chassis 262 of the dolly 260 can lie generally horizontal to carry articles on the top side 264. In this particular mode, an additional set of wheels 284 are removably attachable to the second end 282 of the chassis 262, as seen in FIGS. 21A–23. It should be noted that when used as a hand truck, the second set of wheels 284 at the second end of the chasse can be easily removed to avoid obstruction. Specifically, the axle 286 rotatably supporting the second set of wheels can be removed with use of clips 287 secured to the bottom 266 of the chassis 262. In this manner, the assembled axle 286 and wheels 284 can be quickly removed.

The dolly 260 is further provided with strap means 290 fitted to the chassis 262 for securing one or more articles carried on the dolly. In the preferred embodiment, a longitudinal set of straps 292 are provided as well as a transverse set of straps 294. Each set of straps includes two extensions which secure at opposite free ends with a buckle device 296. The opposite end of one of the strap extensions is secured to the frame structure 262 while the other end is fitted to a ratchet mechanism 298. The ratchet mechanisms 298 are used for tightening the straps 292, 294 about the articles carried on the dolly, after the free ends of the strap extensions are secured with the buckle 296.

Figure 23:
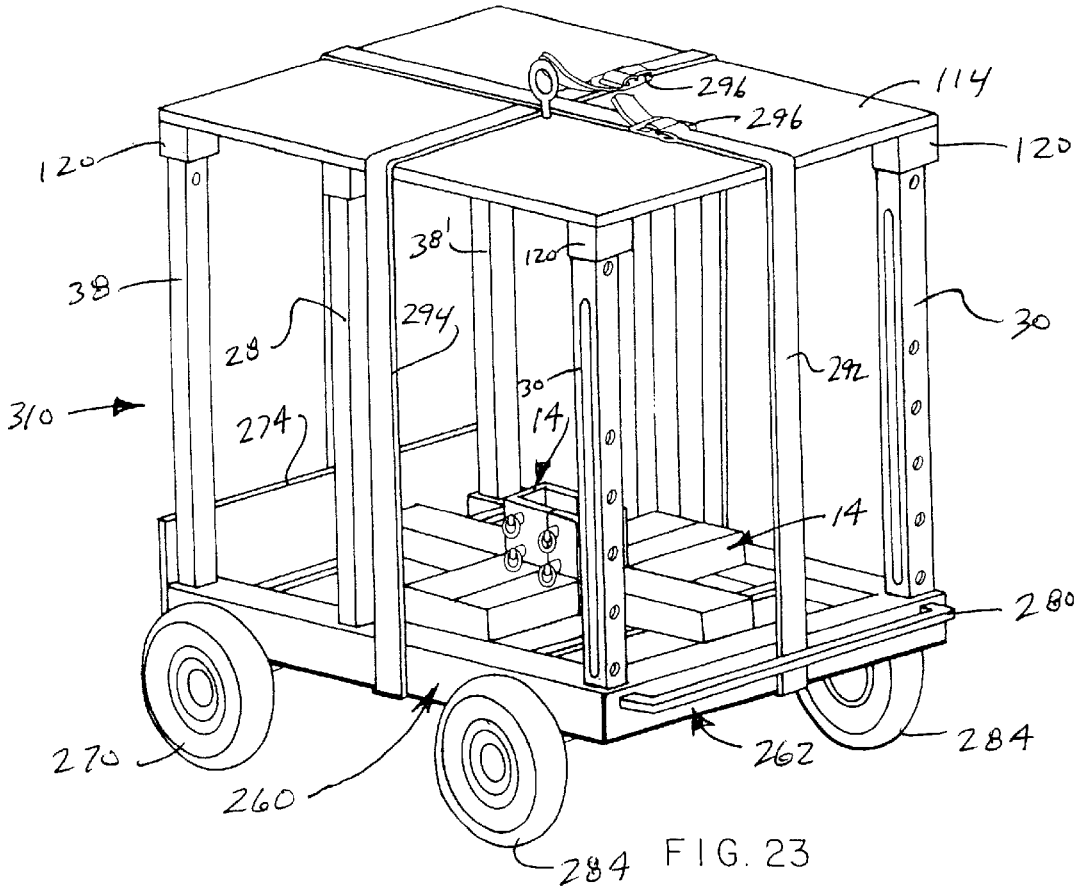
FIG. 23 is a perspective view showing the posts of the primary frame structure fitted to the dolly to provide a transportable cart.
Figure 25:
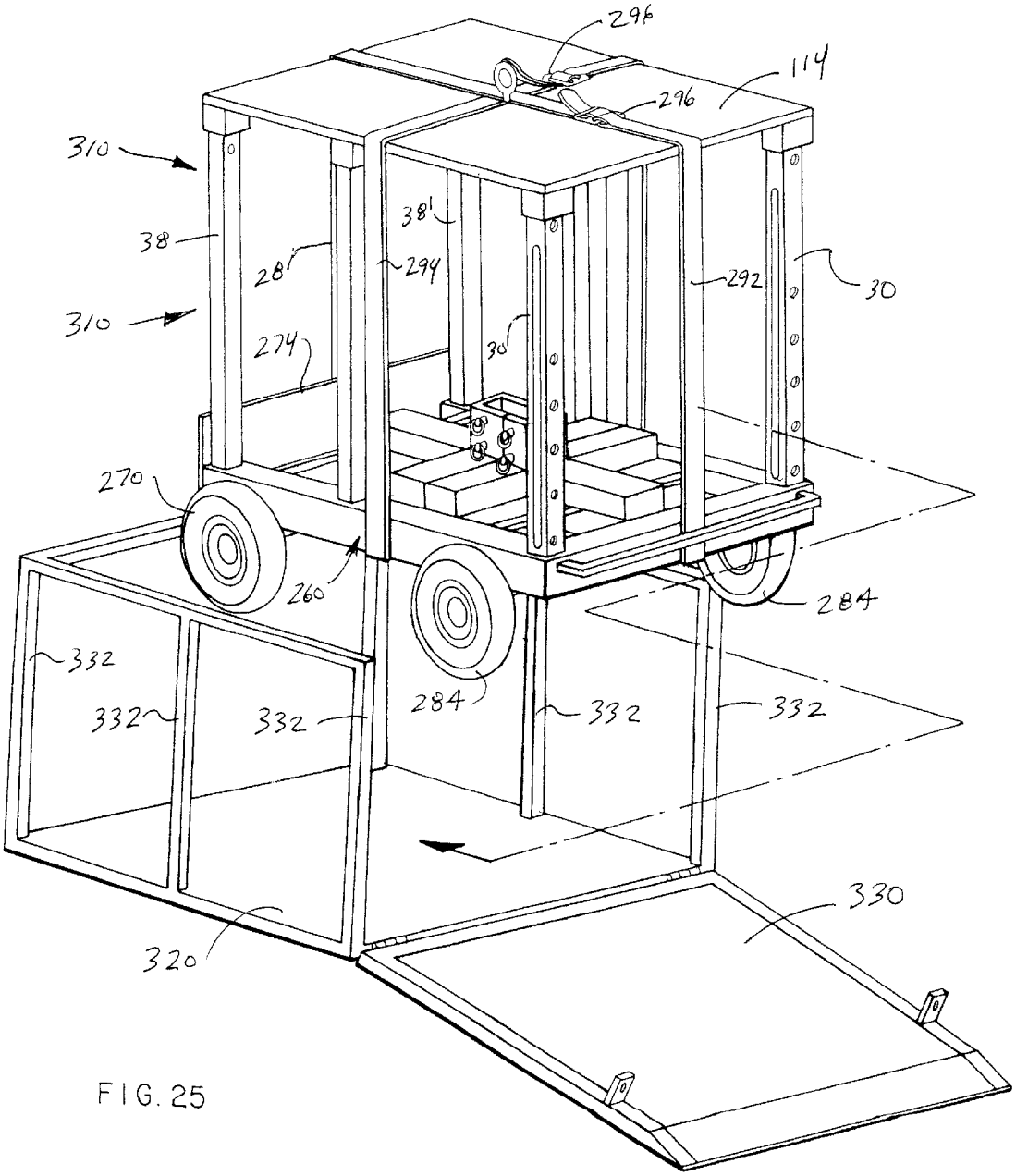
FIG. 25 is a perspective view illustrating placement of the dolly on the tail gate platform of FIG. 24.

The chasse is further provided with socket means 300 on the top side 264 for receipt of the upper and lower post members 28, 30 and the cross beam members 38, 38' therein, in generally perpendicular, upstanding relation, as shown in FIGS. 23 and 25. Additionally, the mounting plate 114 of the speed bag assembly 110 is secured to the top ends of the post members and beam members, to provide a roof, and thereby defining a fully assembled cart 310 as shown in FIGS. 23 and 25. The chassis 262 is specifically structured to accommodate the T-shaped base members 14, in the position shown in FIGS. 23 and 25. Further, the carry bag 250 and accessory components can be placed within the cart 310 for transport between training locations.

Figure 24:
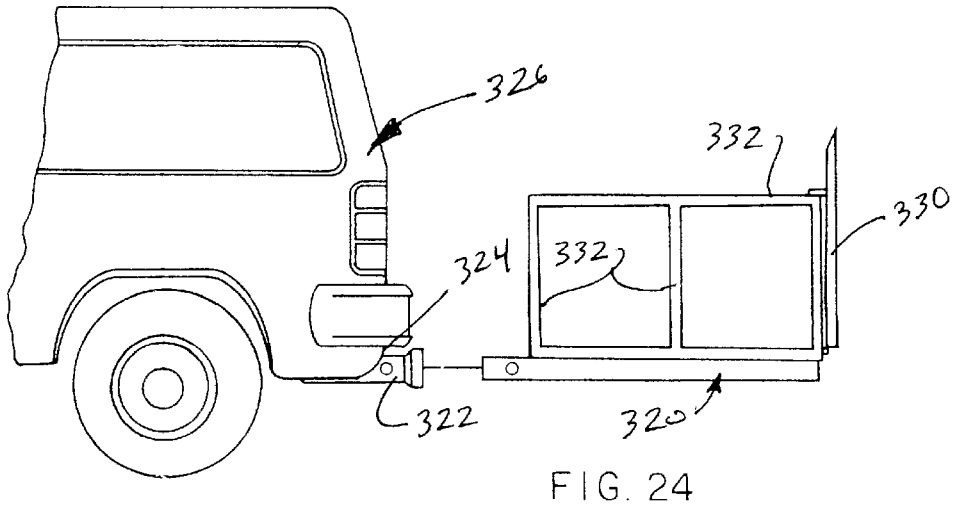
FIG. 24 is a side elevational view of a trailer hitch platform for carrying the cart of FIG. 23 with the accessory components of the apparatus therein, on the tail gate of a vehicle.

Referring to FIGS. 24 and 25, a tail gate platform 320 is provided for attachment to a trailer hitch receptacle 322 on the tail gate 324 of a vehicle 326. The tail gate platform assembly 320 includes a foldable ramp 330 which lowers to enable the assembled cart 310 to be wheeled up and onto the platform 320. Once on the platform, the ramp 330 is raised and locked in the raised position, as shown in FIG. 24. Side railings 332 surround the cart 310 and are high enough to prevent the cart from falling off of the tail gate platform 320 wherein the vehicle 326 maneuvers around turns. It is further suggested that the cart 310 be anchored to the tail gate platform, using string, cord, or other means to prevent relative movement of the cart on the tail gate platform.

Figure 26:
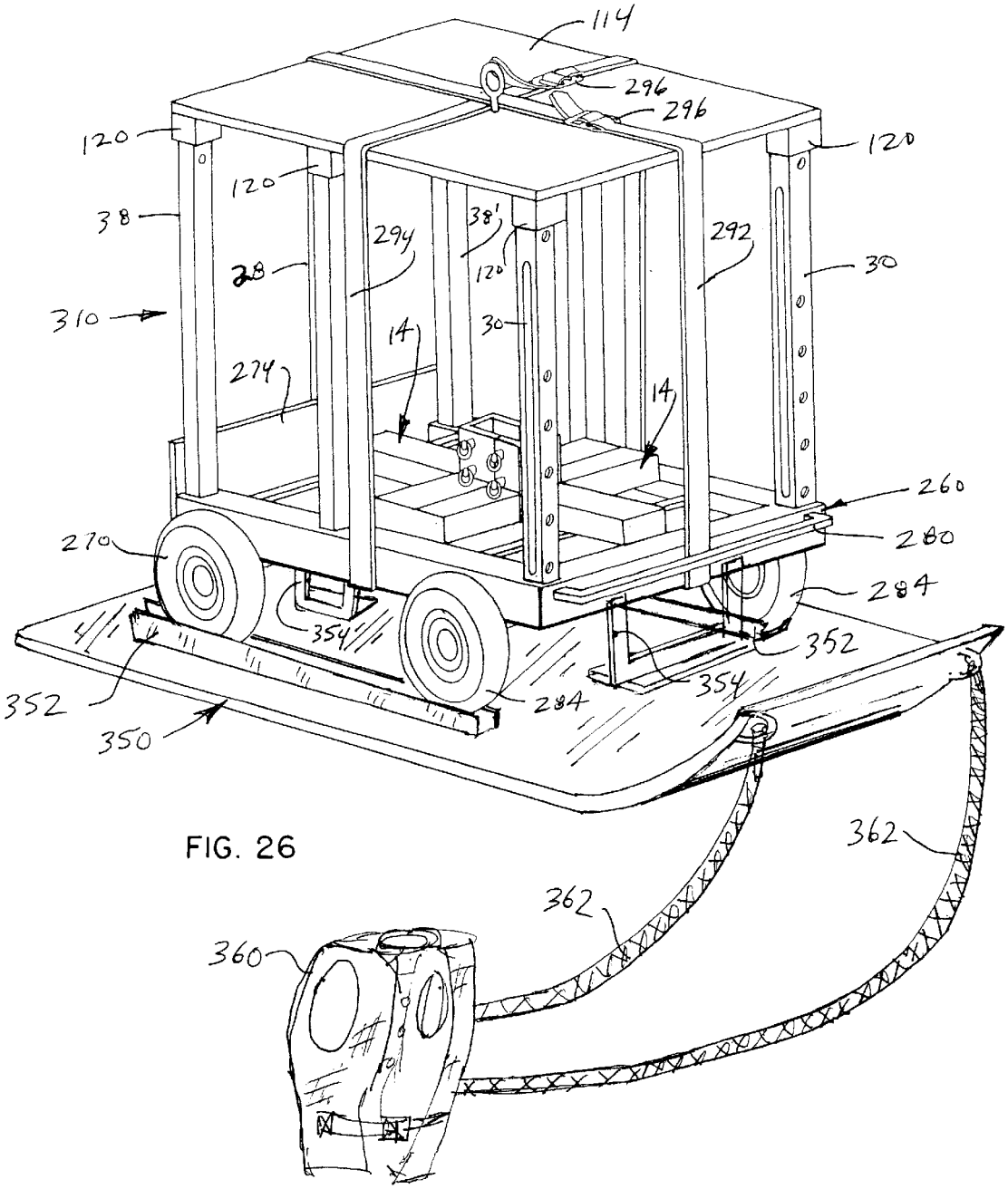
FIG. 26 is a perspective view showing the cart mounted on a sled for pulling the apparatus across sand, snow or like terrain.

Referring to FIG. 26, a sled device 350 is shown for transporting the cart 310 across the sand, snow or like terrain. Specifically, the sled includes tracks 352 for receipt of the wheels 270, 284 of the cart 310. Further, the sled 350 includes brackets 354 for attaching the chassis 262 of the cart 310 to the sled. Additionally, a harness 360 is provided for wearing about the torso of the person pulling the sled 350. The harness 360 secures to the sled with one or more cords 362, chains or the like.

Figure 5:
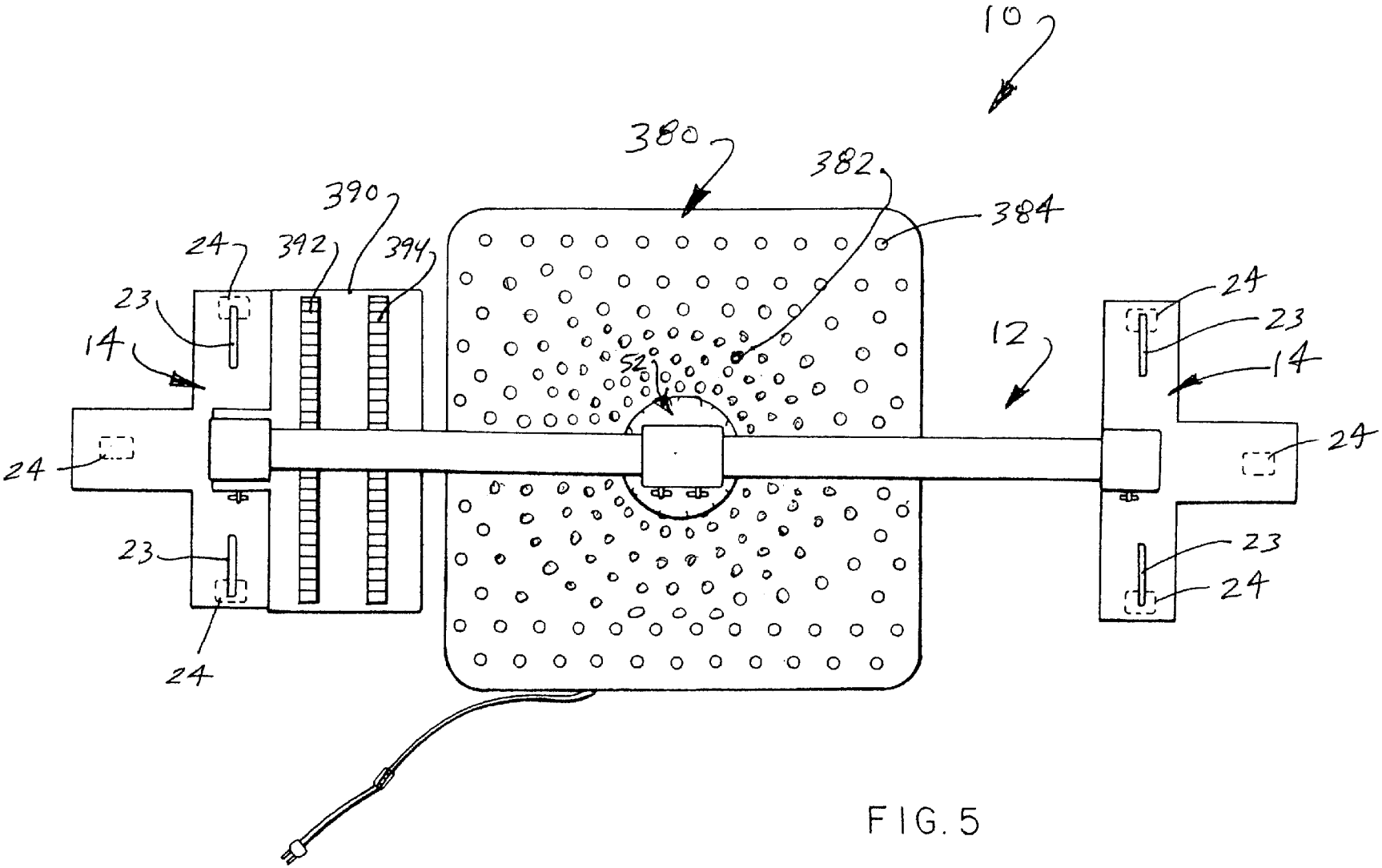
FIG. 5 is a top plan view of the multi-purpose training apparatus showing training components for handicap persons, and specifically an electronic mat for use by blind individuals while training on a heavy bag and a separate accessory device for wheelchair race training.

Referring to FIG. 5, several other components are shown for use in conjunction with the apparatus 10. These particular components are useful for handicapped persons using the apparatus to train in various activities including boxing, martial arts, and wheelchair racing. Specifically, a mat 380 is provided for use by blind individuals for training in the martial arts and boxing. The mat includes a plurality of bumps or other protruding devices on the top surface which the user can feel on the bottom of his/her feet. The bumps are specifically arranged and spaced relative to one another to allow the person to determine their position relative to the heavy bag 52 or other object supported on the frame structure 12. Specifically, the bumps or other protruding members on the top surface of the mat may be arranged to be closer together towards a center of the mat, and spaced further apart around the periphery. For instance, bumps 382 are arranged in closer, spaced relation and may be smaller in size, while bumps 384, towards the outer periphery of the mat, are arranged in further spaced relation and may be larger in size. Additionally, each of the bumps may be associated with a switch device which emits a sound signal. Depending upon which of the protruding bumps the person steps on, a different tone or signal is emitted. For example, when applying pressure, with the feet, to bump 382, which is closer to the center of the mat, a higher pitch signal might be emitted as opposed to a lower pitch signal when stepping on bump 384 at the outer periphery of the mat. In this manner, a blind person, or a person with impaired vision, can determine their position relative to the heavy bag 52 by the sense of touch and/or sound.

FIG. 5 illustrates an accessory device for wheelchair race training. Specifically, the device 390 is attachable in adjacent position to one of the base members 14 with rollers 392, 394 positioned upwardly for receipt of the rear wheels of a wheelchair therebetween. Upon rotating the rear wheels of a wheelchair, using one's hands and arms, the wheelchair wheels engage the rollers 392, 394, allowing the wheels of the wheelchair to rotate while the wheelchair remains stationary. The tension of the rollers 392, 394 can be adjusted to vary the resistance, thereby enabling strength and endurance training.

While the instant invention has been shown and described in accordance with preferred and practical embodiments thereof, it is recognized that departures may be made from the instant disclosure which, therefore, should not be limited except as set forth in the following claims as interpreted under the doctrine of equivalents.

What is claimed is:

1. A training apparatus comprising:

a primary frame structure operable between a collapsed condition and a plurality of assembled conditions defined by a plurality of different structural configurations, and said primary frame structure including:

first and second base members, each of said base members having a generally T-shaped configuration defined by three feet sections, and a post socket extending upwardly from the top side of the base member at a juncture of said feet extensions;

a pair of vertical post assemblies, each of said vertical post assemblies including a lower post member and an upper post member, said lower post member being structured and disposed to accommodate sliding, telescoping receipt of said upper post member therein;

said lower post members each including a bottom end zone structured and disposed for fitted receipt within said post socket of a respective one of said base members;

said upper post members each including a top end zone having a hollow receptacle formed therethrough;

height adjustment means for interlocking said upper post members to said respective lower post members at a plurality of telescopically adjusted positions in order to selectively adjust the height of said top end zone of said upper post members relative to said first and second base members;

means for locking said bottom end zone of said lower post members within said post sockets of said respective base members so that said vertical post assemblies extend vertically upward from said base members; and a horizontal cross beam assembly structured for fitted, sliding receipt within said hollow receptacles of said upper post members, said horizontal cross beam assembly including first and second elongate cross beam extensions and a central coupling for releasable attachment of said cross beam extensions in end-to-end arrangement so that said cross beam extensions are disposed along a common longitudinal axis to define a fully assembled length of said horizontal cross beam assembly;

a plurality of accessory components including a plurality of arm members, said plurality of arm members including:

at least one first arm member having an elbow portion and said first arm member including means for selectively adjusting an angle of said arm member at said elbow portion at a plurality of fixed, adjusted angular positions, and said first arm member further including a target pad assembly fitted thereto and including shock absorbing means for absorbing impact of punches and kicks striking said target pad assembly;

at least one dual arm assembly having a separation bar and a pair of arms extending from opposite ends of said separation bar, each of said arms including a target pad fixed to an end thereof, and said dual arm assembly further including means for rotating each of said arms about a central axis extending longitudinally through said separation bar to selectively adjust s aid target pads at a plurality of angular adjusted positions;

attachment means for removable attachment of each of said plurality of accessory components to said primary frame structure; and adjustment means for selectively adjusting an attached position of individual ones of said plurality of accessory components on said primary frame structure.

2. The training apparatus as recited in claim 1 wherein said first and second base members further include spring loaded wheels mounted to said bottom side, said spring loaded wheels being structured and disposed to be operable between a lowered position to facilitate movement of said base members along a floor surface and a retracted position to stabilize said base members on the floor surface.

3. The training apparatus as recited in claim 1 wherein said first and second base members further include handle means on said top side to facilitate lifting and carrying of said first and second base members.

4. The training apparatus as recited in claim 3 wherein said plurality of accessory components includes a heavy bag structured and disposed for removable mounting to said horizontal cross beam assembly.

5. The training apparatus as recited in claim 3 wherein said accessory components include a speed bag assembly including a speed bag and a mounting plate structured for removable attachment to said primary frame structure.

6. The training apparatus as recited in claim 3 wherein said accessory components include a weight lifting apparatus including a plurality of weight elements supported in stacked relation and vertically movable on a central post extending through said plurality of weight elements, and cable and pulley means for raising a selected number of said plurality of weight elements on said central post and including a handle for applying a lifting force on said cable and pulley means to thereby raise said selected amount of weight elements, and said weight lifting apparatus including wheel means for transporting said weight lifting apparatus across the floor surface.

7. The training apparatus as recited in claim 3 wherein said plurality of accessory components includes a beverage holder and cooler device formed and configured in the shape of an arm and hand, said hand including a freezable substance contained therein and said hand being structured and disposed to receive and hold a beverage.

8. The training apparatus as recited in claim 3 wherein said accessory components include a pivotal stand for supporting a television or computer monitor thereon.

9. A training apparatus comprising:

a primary frame structure operable between a collapsed condition and a plurality of assembled conditions defined by a plurality of different structural configurations, and said primary frame structure including:

first and second base members, each of said base members having a generally T-shaped configuration defined by three feet sections, and a post socket extending upwardly from the top side of the base member at a juncture of said feet extensions;

a pair of vertical post assemblies, each of said vertical post assemblies including a lower post member and an upper post member, said lower post member being structured and disposed to accommodate sliding, telescoping receipt of said upper post member therein;

said lower post members each including a bottom end zone structured and disposed for fitted receipt within said post socket of a respective one of said base members;

said upper post members each including a top end zone having a hollow receptacle formed therethrough;

height adjustment means for interlocking said upper post members to said respective lower post members at a plurality of telescopically adjusted positions in order to selectively adjust the height of said top end zone of said upper post members relative to said first and second base members;

means for locking said bottom end zone of said lower post members within said post sockets of said respective base members so that said vertical post assemblies extend vertically upward from said base members; and a horizontal cross beam assembly structured for fitted, sliding receipt within said hollow receptacles of said upper post members, said horizontal cross beam assembly including first and second elongate cross beam extensions and a central coupling for releasable attachment of said cross beam extensions in end-to-end arrangement so that said cross beam extensions are disposed along a common longitudinal axis to define a fully assembled length of said horizontal cross beam assembly;

a plurality of accessory components including a plurality of arm members, said plurality of arm members including:

at least one first arm member having an elbow portion and said first arm member including means for selectively adjusting an angle of said arm member at said elbow portion at a plurality of fixed, adjusted angular positions, and said first arm member further including a target pad assembly fitted thereto and including shock absorbing means for absorbing impact of punches and kicks striking said target pad assembly;

at least one dual arm assembly having a separation bar and a pair of arms extending from opposite ends of said separation bar, each of said arms including a target pad fixed to an end thereof, and said dual arm assembly further including means for rotating each of said arms about a central axis extending longitudinally through said separation bar to selectively adjust said target pads at a plurality of angular adjusted positions;

means for removable and adjustable attachment of each of said plurality of accessory components to said primary frame structure and including a plurality of spaced apertures formed through said pair of vertical post assemblies and said horizontal cross beam assembly and a plurality of locking pin members structured and disposed for selective receipt through said spaced apertures, and said means for removable and adjustable attachment further including correspondingly aligned elongate slots on said upper and lower post members of each of said pair of vertical post assemblies.

10. A training apparatus comprising:

a primary frame structure operable between a collapsed condition and a plurality of assembled conditions defined by a plurality of different structural configurations, said primary frame structure including first and second vertical post assemblies each having an upper end, and a horizontal cross beam assembly, said plurality of different structural configurations of said assembled primary frame structure including a first assembled configuration defined by said horizontal cross beam assembly attached to and extending between said upper ends of said first and second vertical post assemblies, and said plurality of different structural configurations further including a football goal post configuration and a soccer goal configuration;

a plurality of accessory components including a plurality of arm members, said plurality of arm members including:

at least one first arm member having an elbow portion and said first arm member including means for selectively adjusting an angle of said arm member at said elbow portion at a plurality of fixed, adjusted angular positions, and said first arm member further including a target pad assembly fitted thereto and including shock absorbing means for absorbing impact of punches and kicks striking said target pad assembly; and at least one dual arm assembly having a separation bar and a pair of arms extending from opposite ends of said separation bar, each of said arms including a target pad fixed to an end thereof, and said dual arm assembly further including means for rotating each of said arms about a central axis extending longitudinally through said separation bar to selectively adjust said target pads at a plurality of angular adjusted positions; and means for removable and adjustable attachment of each of said plurality of accessory components to said primary frame structure.

* * * * *